US005282443A

United States Patent [19]

Fujiyoshi et al.

[11] Patent Number: 5,282,443

[45] Date of Patent: Feb. 1, 1994

[54] VALVE OPERATING SYSTEM IN INTERNAL COMBUSTION ENGINE

[75] Inventors: Yoshihiro Fujiyoshi; Yasuhiro Urata; Hiroshi Sono; Kouichi Fukuo, all of Saitama, Japan

[73] Assignee: Honda Giken Kogyo Kabushiki Kaisha, Tokyo, Japan

[21] Appl. No.: 988,441

[22] Filed: Dec. 9, 1992

[30] Foreign Application Priority Data

Dec. 9, 1991 [JP] Japan ..... 3-324317

[51] Int. Cl.[5] ..... F01L 1/34

[52] U.S. Cl. ..... 123/90.16; 123/90.39

[58] Field of Search ..... 123/90.12, 90.15, 90.16, 123/90.27, 90.39, 90.4

[56] References Cited

U.S. PATENT DOCUMENTS

| | | | |
|---|---|---|---|
| 4,905,639 | 3/1990 | Konno | 123/90.16 |
| 4,957,076 | 9/1990 | Inoue et al. | 123/90.16 |
| 5,036,807 | 8/1991 | Kaneko | 123/90.16 |
| 5,036,810 | 8/1991 | Meneely | 123/90.16 |
| 5,099,806 | 3/1992 | Murata et al. | 123/90.16 |
| 5,113,811 | 5/1992 | Rembold et al. | 123/90.16 |

FOREIGN PATENT DOCUMENTS

| | | |
|---|---|---|
| 276532 | 8/1988 | European Pat. Off. . |
| 406026 | 1/1991 | European Pat. Off. . |
| 229912 | 10/1986 | Japan . |
| 37005 | 1/1991 | Japan . |
| 9003499 | 4/1990 | PCT Int'l Appl. . |
| 404426 | 1/1934 | United Kingdom . |

*Primary Examiner*—E. Rollins Cross
*Assistant Examiner*—Weilun Lo
*Attorney, Agent, or Firm*—Lyon & Lyon

[57] ABSTRACT

A valve operating system in an internal combustion engine comprises an operating-force generating means for generating an operating force corresponding to the revolution of the engine, an operating-force applying means for operating an engine valve, a hydraulic transmitting means capable of hydraulically transmitting the operating force between the operating-force generating means and the operating-force applying means, a mechanical transmitting means capable of rigidly transmitting the operating force between the operating-force generating means and the operating-force applying means, and a selective switchover means capable of alternatively switching-over the transmissions of the operating force from the operating-force generating means to the operating-force applying means by the hydraulic transmitting means and by the mechanical transmitting means. Thus, it is possible to select either the transmission of the operating force by the hydraulic transmitting means or the transmission of the operating force by the mechanical transmitting means to insure a reliable operation of the engine valve.

18 Claims, 27 Drawing Sheets

VALVE OPERATING SYSTEM IN INTERNAL COMBUSTION ENGINE

BACKGROUND OF THE INVENTION

1. Field of the Invention

The present invention relates to a valve operating system in an internal combustion engine.

2. Description of the Prior Art

A valve operating system in an internal combustion engine is conventionally already known, for example, from Japanese Patent Application Laid-open No. 229912/86, which comprises a hydraulic transmitting means which is capable of hydraulically transmitting the operating force and is provided between an operating-force generating means for generating an operating force corresponding to the revolution of the engine and an operating-force applying means for operating an engine valve.

The above prior art valve operating system has an advantage that the opening and closing characteristic of the engine valve can be accurately controlled by varying the operating-force transmitting mode of the hydraulic transmitting means by the control of the hydraulic pressure. On the other hand, a slide member having an extremely small clearance is required for the hydraulic transmitting means in order to convert the hydraulic pressure into the operating force. When the introduction of a working oil having an extremely low temperature or an inappropriate viscosity results in an abnormally increased viscosity of the working oil, the slide member is accompanied by a large resistance to the operation due to a resistance to the sliding movement thereof in the clearance area and a resistance to the flow of the working oil having an abnormally high viscosity and hence, a delay may be produced in the operation of the engine valve in some cases. When an abnormal closing of an oil passage in the hydraulic transmitting means, an abnormality of an oil supply source or the like is produced, it is difficult to transmit the operating force by the hydraulic transmitting means.

There is also a conventionally known valve operating system which comprises a mechanical transmitting means for mechanically transmitting the operating force between the operating-force generating means and the operating-force applying means, as disclosed in Japanese Patent Publication No. 7005/91. In this system, a reliable transmittion of the operating force is possible, but it is difficult to accurately control the opening and closing characteristic of the engine valve.

SUMMARY OF THE INVENTION

Accordingly, it is an object of the present invention to provide a valve operating system in an internal combustion engine, wherein the transmission of the operating force by the hydraulic transmitting means and the transmission of the operating force by the mechanical transmitting means can be alternatively switched over from one to the other to insure a reliable operation of the engine valve.

To achieve the above object, according to the present invention, there is provided a valve operating system in an internal combustion engine, comprising an operating-force generating means for generating an operating force corresponding to the revolution of the engine, an operating-force applying means for operating an engine valve, a hydraulic transmitting means capable of hydraulically transmitting the operating force between the operating-force generating means and the operating-force applying means, a mechanical transmitting means capable of transmitting the operating force between the operating-force generating means and the operating-force applying means, and a selective switchover means capable of alternatively switching-over between the transmission of the operating force from the operating-force generating means to the operating-force applying means by the hydraulic transmitting means and the transmission of the operating force from the operating-force generating means to the operating-force applying means by the mechanical transmitting means.

With the above construction, when the transmission of the operating force by the hydraulic transmitting means is unreliable, the operating force can be reliably transmitted to the engine valve by the mechanical transmitting means, thereby insuring a reliable operation of the engine valve. When the reliable transmission of the operating force by the hydraulic transmitting means is possible, the operational characteristic of the engine valve can be accurately controlled by the transmission of the operating force by the hydraulic transmitting means.

The above and other objects, features and advantages of the invention will become apparent from a consideration of the following description of the preferred embodiments, taken in conjunction with the accompanying drawings.

BRIEF DESCRIPTION OF THE DRAWINGS

FIGS. 1 to 5 illustrate a first embodiment of the present invention, wherein FIG. 1 is a diagrammatic view of the entire arrangement;

FIG. 2 is a partial longitudinal sectional side view of an engine, taken along a line 2—2 in FIG. 3;

FIG. 3 is a sectional view taken along a line 3—3 in FIG. 2;

FIG. 4 is a partial longitudinal sectional side view of an engine, taken along a line 4—4 in FIG. 3; and FIG. 5 is an enlarged longitudinal sectional view of a hydraulic pressure releasing valve;

FIGS. 6 to 10 illustrate a second embodiment of the present invention, wherein FIG. 6 is a diagrammatic view of the entire arrangement;

FIG. 7 is a partial longitudinal sectional side view of the engine taken along a line 7—7 in FIG. 8;

FIG. 8 is a sectional view taken along a line 8—8 in FIG. 7;

FIG. 9 is a partial longitudinal sectional side view of the engine, taken along a line 9—9 in FIG. 8; and FIG. 10 is a partial longitudinal sectional side view of the engine, taken along a line 10—10 in FIG. 8;

FIGS. 11 to 15 illustrate a third embodiment of the present invention, wherein FIG. 11 is a diagrammatic view of the entire arrangement;

FIG. 12 is a partial longitudinal sectional side view of the engine, taken along a line 12—12 in FIG. 13;

FIG. 13 is a sectional view taken along a line 13—13 in FIG. 12;

FIG. 14 is a partial longitudinal sectional side view of the engine, taken along a line 14—14 in FIG. 13; and FIG. 15 is a partial longitudinal sectional side view of the engine, taken along a line 15—15 in FIG. 13;

FIGS. 16 to 21 illustrate a fourth embodiment of the present invention, wherein

FIG. 16 is a diagrammatic view of the entire arrangement;

FIG. 17 is a partial longitudinal sectional side view of the engine, taken along a line 17—17 in FIG. 18;

FIG. 18 is a sectional view taken along a line 18—18 in FIG. 17;

FIG. 19 is a partial longitudinal sectional side view of the engine, taken along a line 19—19 in FIG. 18;

FIG. 20 is a partial longitudinal sectional side view of the engine, taken along a line 20—20 in FIG. 18; and FIG. 21 is a partial longitudinal sectional side view of the engine, taken along a line 21—21 in FIG. 18; and FIGS. 22 to 27 illustrate a fifth embodiment of the present invention, wherein FIG. 22 is a diagrammatic view of the entire arrangement;

FIG. 23 is a partial longitudinal sectional side view of the engine, taken along a line 23—23 in FIG. 24;

FIG. 24 is a sectional view taken along a line 24—24 in FIG. 23;

FIG. 25 is a partial longitudinal sectional side view of the engine, taken along a line 25—25 in FIG. 24;

FIG. 26 is a partial longitudinal sectional side view of the engine, taken along a line 26—26 in FIG. 24; and FIG. 27 is a partial longitudinal sectional side view of the engine, taken along a line 27—27 in FIG. 24.

DESCRIPTION OF THE PREFERRED EMBODIMENTS

A first embodiment of the present invention will first be described in connection with FIGS. 1 to 5.

Figure 1:
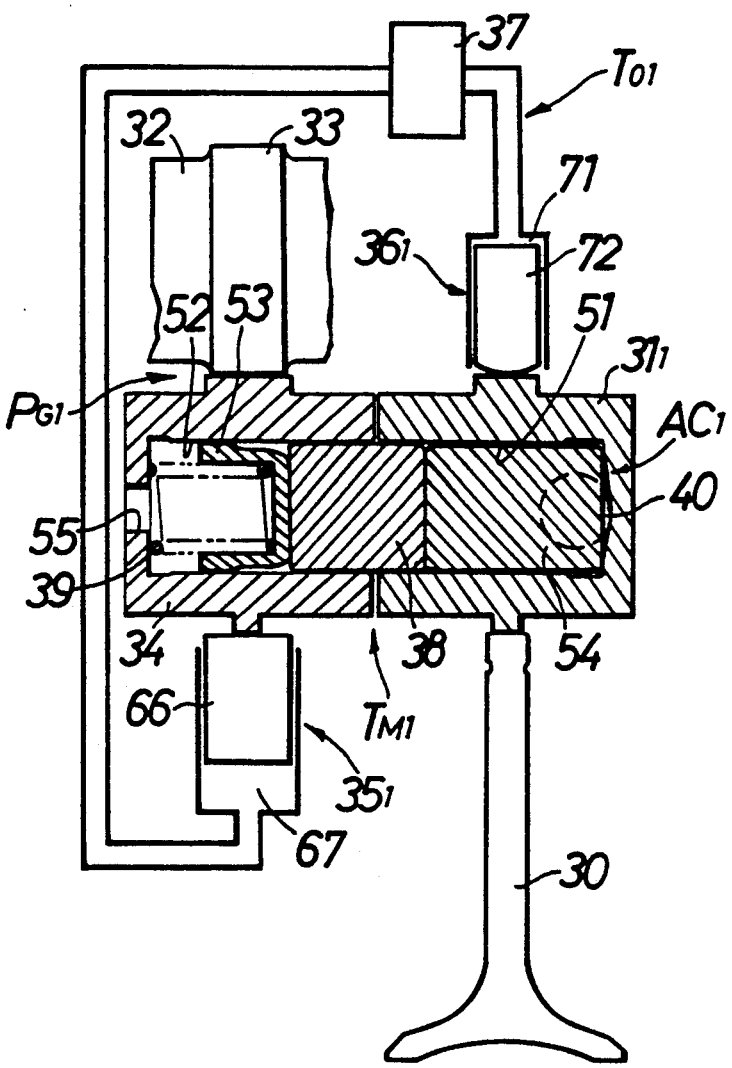

Referring to FIG. 1, a valve operating system for driving an intake valve 30 as an engine valve for opening and closing thereof comprises an operating-force generating means $P_{G1}$ for generating an operating force corresponding to the revolution of an engine, a drive rocker arm $31_1$ as an operating-force applying means for operating the intake valve 30, a hydraulic transmitting means $T_{01}$ capable of hydraulically transmitting the operating force from the operating-force generating means $P_{G1}$ to the drive rocker arm $31_1$, a mechanical transmitting means $T_{M1}$ capable of mechanically transmitting the operating force from the operating-force generating means $P_{G1}$ to the drive rocker arm $31_1$, and a selective switchover means $AC_1$ capable of alternatively switching-over, from one to another, the transmission of the operating force from the operating-force generating means $P_{G1}$ through the hydraulic transmitting means $T_{01}$ to the drive rocker arm $31_1$ and the transmission of the operating force from the operating-force generating means $P_{G1}$ through the mechanical transmitting means $T_{M1}$ to the drive rocker arm $31_1$.

The operating-force generating means $P_{G1}$ is comprised of a cam 33 provided on a cam shaft 32 operatively connected to a crank shaft (not shown) at a reduction ratio of ½, and a free rocker arm 34 adapted to be swingably driven by the cam 33. The hydraulic transmitting means $T_{01}$ comprises a hydraulic pressure generating portion $35_1$ for generating a hydraulic pressure corresponding to the operation of the free rocker arm 34, an operating-force conversion portion $36_1$ for converting the hydraulic pressure from the hydraulic pressure generating portion $35_1$ into an operating force, a hydraulic pressure releasing valve 37 capable of releasing the hydraulic pressure in the operating-force conversion portion $36_1$. The mechanical transmitting means $T_{M1}$ comprises the drive rocker arm $31_1$ and the free rocker arm 34 which are disposed adjacent each other, and a connecting pin 38 which is movable between a position in which it connects the rocker arms $31_1$ and 34 to each other and a position in which it disconnects the rocker arms $31_1$ and 34 from each other. Further, the selective switchover means $AC_1$ is constructed so that a biasing force in a direction toward the disconnecting position is produced by a hydraulic pressure in a hydraulic pressure chamber 40 controllable in hydraulic pressure for switchover from one of high and low values to the other is applied and the connecting pin 38 is biased toward the connecting position by a spring 39.

Figure 3:
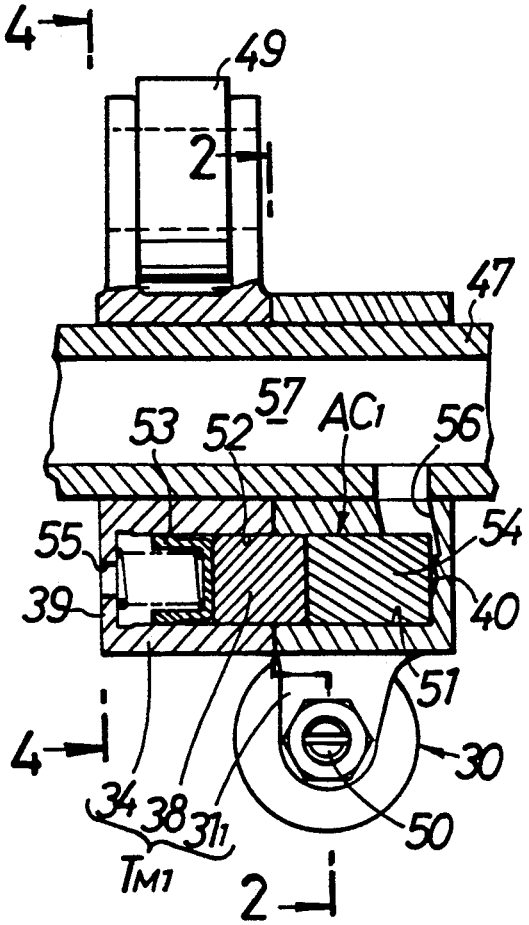
Figure 4:
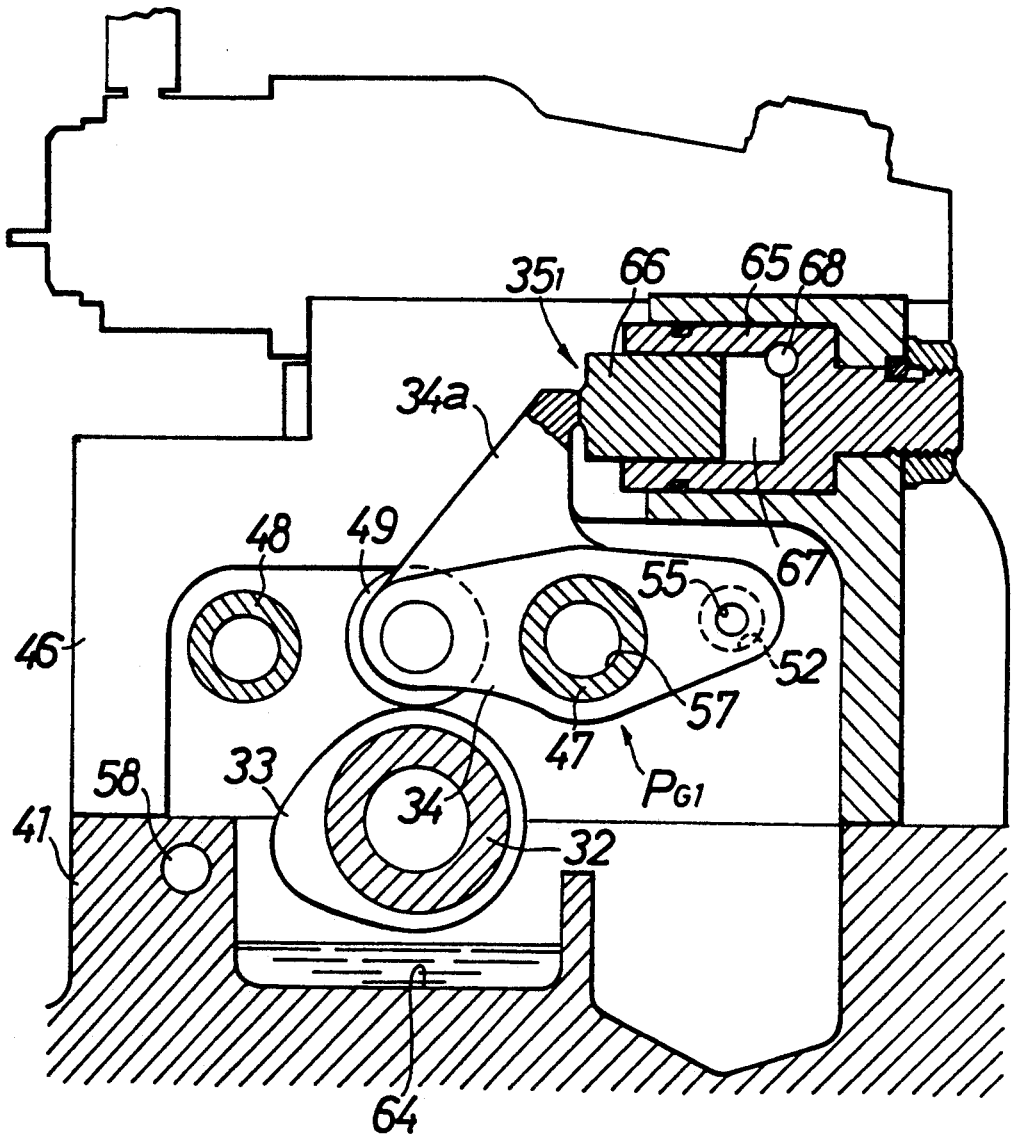

The detail construction of the operating-force generating means $P_{G1}$, the hydraulic transmitting means $T_{01}$, the mechanical transmitting means $T_{M1}$, the selective switchover means $AC_1$ and the drive rocker arm $31_1$ will be described below with reference to FIGS. 2, 3 and 4.

Figure 2:
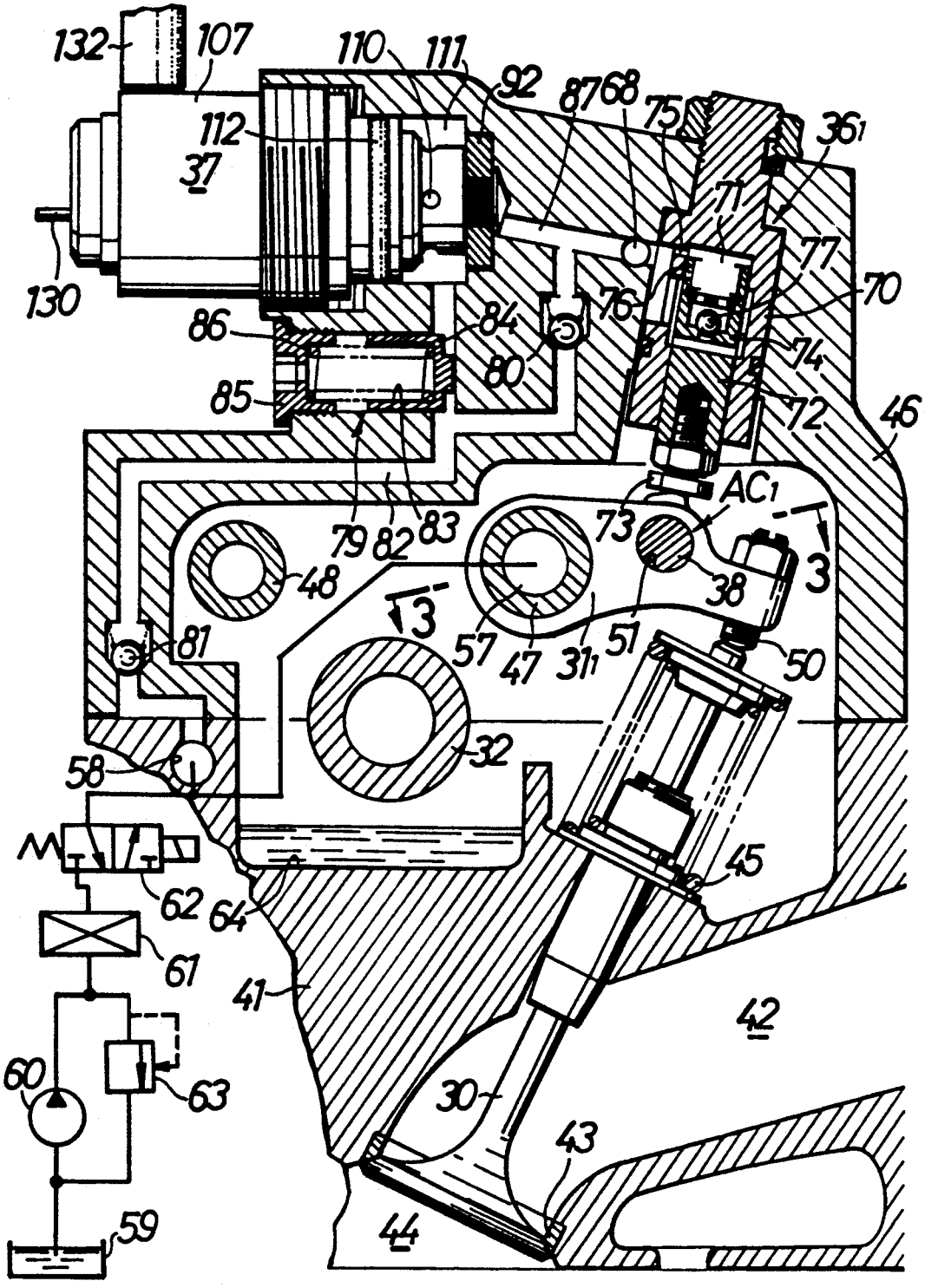

Referring first to FIG. 2, the intake valve 30 is openably and closably mounted in a cylinder head 41 for switching-over the connection and disconnection between an intake valve bore 43 leading to an intake port 42 and a combustion chamber 44. The intake valve 30 is biased in a valve-closing direction by a valve spring 45 which is mounted in a compressed manner between the intake valve 30 and the cylinder head 41. An exhaust valve (not shown) is also openably and closably mounted in the cylinder head 41 for switching-over the connection and disconnection between the combustion chamber 44 and an exhaust port (not shown). This exhaust valve is also biased in a valve-closing direction by a spring.

A support block 46 is fixedly mounted on the cylinder head 41, and a cam shaft 32 is rotatably carried between the support block 46 and the cylinder head 41. Fixed to the support block 46 in parallel to the cam shaft 32 are an intake-side rocker shaft 47 and an exhaust-side rocker shaft 48 which is a component of a mechanical transmitting means (not shown) for driving an exhaust valve (not shown) for opening and closing thereof.

The operating-force generating means $P_{G1}$ comprises the cam 33 provided on the cam shaft 32, and the free rocker arm 34 swingably carried on the intake-side rocker shaft 47. A roller 49 is carried on the free rocker arm 34 by a pin to come into rolling contact with the cam 33. The free rocker arm 34 is biased in a direction to bring the roller 49 into rolling contact with the cam 33 by the hydraulic pressure generating portion $35_1$ in the hydraulic transmitting means $T_{01}$. The rotation of the cam shaft 32 causes the free rocker arm 34 to be swung with a characteristic corresponding to the shape of the cam 33 in response to the revolution of the engine.

The drive rocker arm $31_1$ is swingably carried on the intake-side rocker shaft 47 at a location adjacent the free rocker arm 34. A tappet screw 50 is threadedly engaged in the drive rocker arm $31_1$ to abut against an upper end of the intake valve 30, with the advanced and retracted positions of the tappet screw 50 being adjustable. Thus, the intake valve 30 is opened and closed by swinging movement of the drive rocker arm $31_1$.

A bottomed guide hole 51 is provided in the drive rocker arm $31_1$ in parallel to the intake-side rocker shaft 47 and opened toward the free rocker arm 34. A bottomed guide hole 52 is provided in the free rocker arm 34 in parallel to the rocker shaft 47 and opened toward the drive rocker arm $31_1$. The connecting pin 38 constituting the mechanical transmitting means $T_{M1}$ together with both the rocker arms $31_1$ and 34 is slidably received in the guide hole 52 for movement between the position (shown in FIG. 3) in which it is fitted into both the guide holes 51 and 52 to stiffly connect both the rocker arms $31_1$ and 34 to each other and the position in which the connection between the rocker arms $31_1$ and 34 is released.

The selective switchover means $AC_1$ comprises a restraining member 53, the spring 39, and a switchover piston 54. The restraining member 53 is formed into a bottomed cylindrical shape and slidably received in the guide hole 52 to abut against one end of the connecting pin 38. The spring 39 is mounted in a compressed manner between a closed end of the guide hole 52 and the restraining member 53. The switchover piston 54 is slidably received in the guide hole 51 to abut against the other end of the connecting pin 38 and to define the hydraulic pressure chamber 40 between the piston 54 itself and a closed end of the guide hole 51. An opened perforation 55 is provided in the closed end of the guide hole 52.

In such selective switchover means $AC_1$, the axial length of each of the connecting pin 38, the restraining member 53 and the switchover piston 54 is set so that the connecting pin 38 is fitted into both the guide holes 51 and 52 in a condition in which the switchover piston 54 has been moved to the maximum in a direction to reduce the volume of the hydraulic pressure chamber 40, and so that the abutment surfaces of the connecting pin 38 and the switchover piston 54 are located between the opposed surfaces of the rocker arms $31_1$ and 34 in a condition in which the restraining member 53 has been moved to a position in which it has abutted against the closed end of the guide hole 52.

A communication hole 56 is provided in the drive rocker arm $31_1$ to lead to the hydraulic pressure chamber 40. A hydraulic pressure passage 57 is axially provided in the intake-side rocker shaft 47 to lead to the communication hole 56 irrespective of the swung state of the drive rocker arm $31_1$.

Referring to FIG. 2, the hydraulic pressure passage 57 communicates with an oil passage 58 provided in the cylinder head 41. A filter 61 is connected to a discharge port in a pump 60 for pumping a working oil from an oil pan 59. A solenoid switchover control valve 62 is interposed between the filter 61 and the oil passage 58 and is shiftable between a state permitting the working oil supplied from the pump 60 through the filter 61 to be supplied into the oil passage 58, and a state causing the supply of the working oil into the oil passage 58 to be cut off and to open the oil passage 58. A relief valve 63 is interposed between the discharge port and a suction port in the pump 60. Further, an oil bath 64 for storing oil is provided in an upper portion of the cylinder head 41 below the cam shaft 32.

In the hydraulic transmitting means $T_{01}$, the hydraulic pressure generating portion $35_1$ comprises a first cylinder 65 fixedly received in the support block 46, and a follower piston 66 slidably received in the first cylinder 65. A hydraulic pressure generating chamber 67 is defined between the follower piston 66 and the first cylinder 65, and the follower piston 66 is in sliding contact with an urging portion 34*a* integrally provided on the free rocker arm 34. When the follower piston 66 is slidably driven by the free rocker arm 34 swingably driven by the cam 33, a hydraulic pressure is generated in the hydraulic pressure generating chamber 67.

An oil passage 68 is provided in the first cylinder 65 and the support block 46 to lead to the hydraulic pressure generating chamber 67. The hydraulic pressure from the hydraulic pressure generating chamber 67 is applied to the oil passage 68.

The operating-force conversion portion $36_1$ in the hydraulic transmitting means $T_{01}$ comprises a second cylinder 70 fixed to the support block 46 coaxially with the intake valve 30, and a drive piston 72 operatively connected to the drive rocker arm $31_1$ and slidably received in the second cylinder 70 to define a hydraulic pressure chamber 71 between the drive piston 72 itself and the second cylinder 70. An adjusting screw 73 is threadedly engaged in a lower portion of the drive piston 72 to abut against an upper portion of the drive rocker arm $31_1$, with the advanced and retracted positions of the adjusting screw 73 being adjustable. Thus, when the drive piston 72 is urged downwardly in response to an increase in hydraulic pressure in the hydraulic pressure chamber 71, the drive rocker arm $31_1$ is caused to swing in a direction to open the intake valve 30.

An annular recess 74 is provided in an inner surface of the second cylinder 70 to lead to the oil passage 68, and a constriction hole 75 is provided in the second cylinder 70 for permitting the hydraulic pressure chamber 71 to communicate with the oil passage 68. A variable constriction hole 76 is provided in the drive piston 72 for permitting the hydraulic pressure chamber 71 to communicate with the oil passage 68, so that a flowing area is gradually reduced during closing of the intake valve 30 to a fully closed position from a position in which the intake valve 30 and thus the drive piston 72 has been moved in a valve opening direction by a predetermined amount from the fully closed position. A check valve 77 is mounted in the drive piston 72 for permitting only a flow of the working oil from the annular recess 74 to the hydraulic pressure chamber 71.

Such hydraulic pressure generating portion $35_1$ and operating-force conversion portion $36_1$ are in their as shown in FIG. 2 in the fully closed state of the intake valve 30, when the hydraulic pressures in the hydraulic pressure chamber 71 and the hydraulic pressure generating chamber 67 are not released. If the follower piston 66 is urged in this condition in response to the rotation of the cam 33, the hydraulic pressure generated in the hydraulic pressure generating chamber 67 is introduced through the constriction hole 75 and the check valve 77 into the hydraulic pressure chamber 71, and the drive piston 72 is forced downwardly by the hydraulic pressure in the hydraulic pressure chamber 71, thereby causing the intake valve 30 to be opened against a spring force of the valve spring 45.

When the urging force provided by the cam 33 is released after the intake valve 30 has been brought into its fully opened state, the intake valve 30 is driven upwardly, i.e., in the closing direction by the spring force of the valve spring 45. Such closing operation of the intake valve 30 causes the drive piston 72 to be also urged upwardly, thereby causing the oil in the hydraulic pressure chamber 71 to be returned to the hydraulic pressure generating chamber 67. The amount of working oil returned from the hydraulic pressure chamber 71 to the hydraulic pressure generating chamber 67 is restrained by the variable constriction hole 76 for gradually reducing the flow area in the middle of the closing operation of the intake valve 30, and the speed of upward movement, i.e., closing movement of the intake valve 30 is reduced from the middle to the end of the closing operation, so that the intake valve 30 can be gently seated, leading to only a moderated shock during the seating.

If the hydraulic pressure in the hydraulic pressure chamber 71 is released in the middle of the opening operation of the intake valve 30, the hydraulic pressure chamber 71 loses a transmitting function of overcoming the spring force of the valve spring 45 to maintain the intake valve 30 opened. Therefore, notwithstanding that the cam 33 continues to urge the follower piston 66, the intake valve 30 starts its closing operation from the hydraulic pressure releasing time under the influence of the resilient force of the valve spring 45, thereby reducing the volume of the hydraulic pressure chamber 71.

In order to control the timing of release of the hydraulic pressure from the hydraulic pressure chamber 71, i.e., the lift amount of and the closing timing for the intake valve 30, the hydraulic pressure releasing valve 37, an accumulator 79, a one-way valve 80 and a check valve 81 are disposed in the support block 46.

The accumulator 79 is provided in the middle of an oil passage 82 provided in the support block 46. The accumulator 79 comprises an accumulator piston 84 slidably received in a slide hole 83 provided in the support block 46 to intersect the oil passage 82 in a T-shaped fashion, and a spring 86 mounted in a compressed manner between an occluding member 85 for closing an outer end of the slide hole 83 and the accumulator piston 84.

The hydraulic pressure releasing valve 37 is a solenoid valve interposed between an oil passage 87 provided in the support block 46 in communication with the oil passage 68 and the oil passage 82. The one-way valve 80 is disposed in the support block 46 between the oil passages 87 and 82 to bypass the hydraulic pressure releasing valve 37 and adapted to be opened when the hydraulic pressure in the oil passage 82 becomes larger than the hydraulic pressure in the oil passage 87 by a preset pressure or more, thereby permitting only a flow of the oil from the accumulator 79 toward the oil passage 87, i.e., the hydraulic pressure generating chamber 67 and the hydraulic pressure chamber 71. The check valve 81 is disposed in the support block 46 in such a manner to permit only a flow of the working oil from the oil passage 58 toward the oil passage 82.

Figure 5:
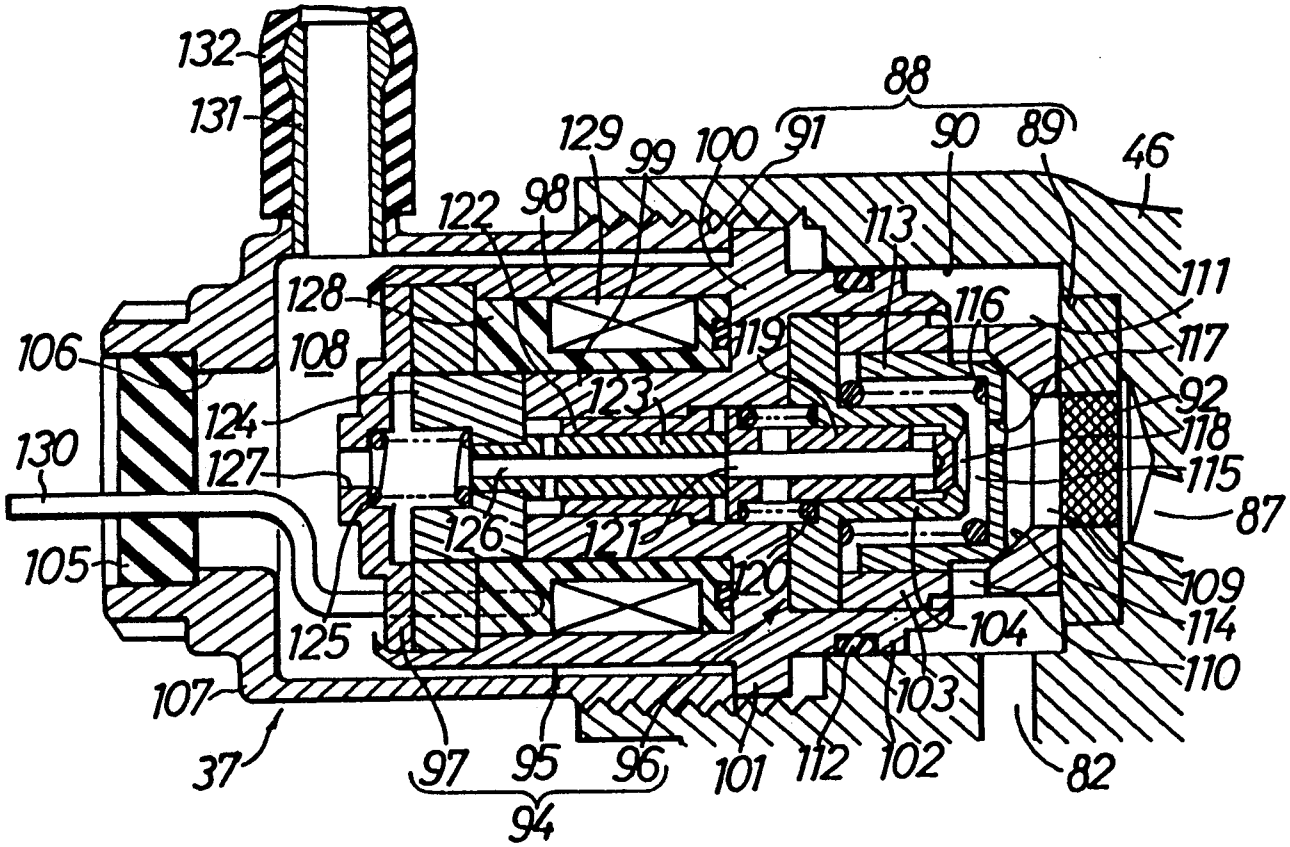
Figure 6:
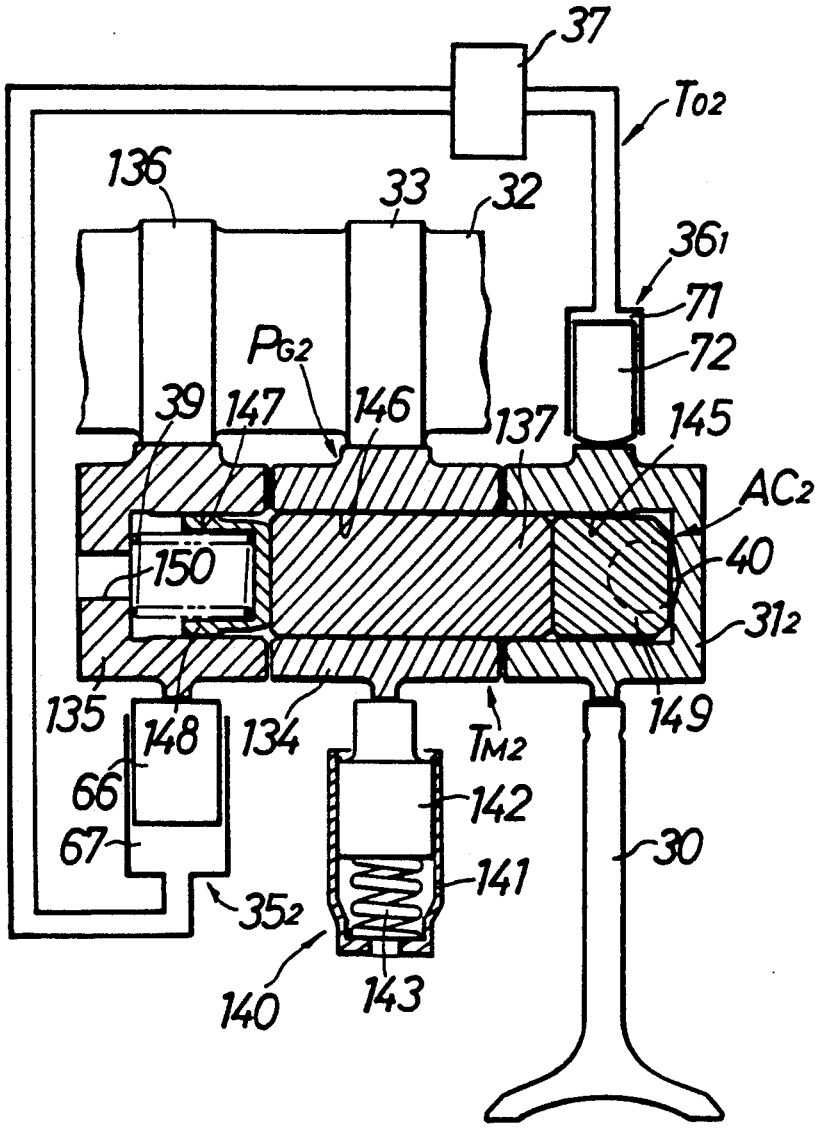
Figure 7:
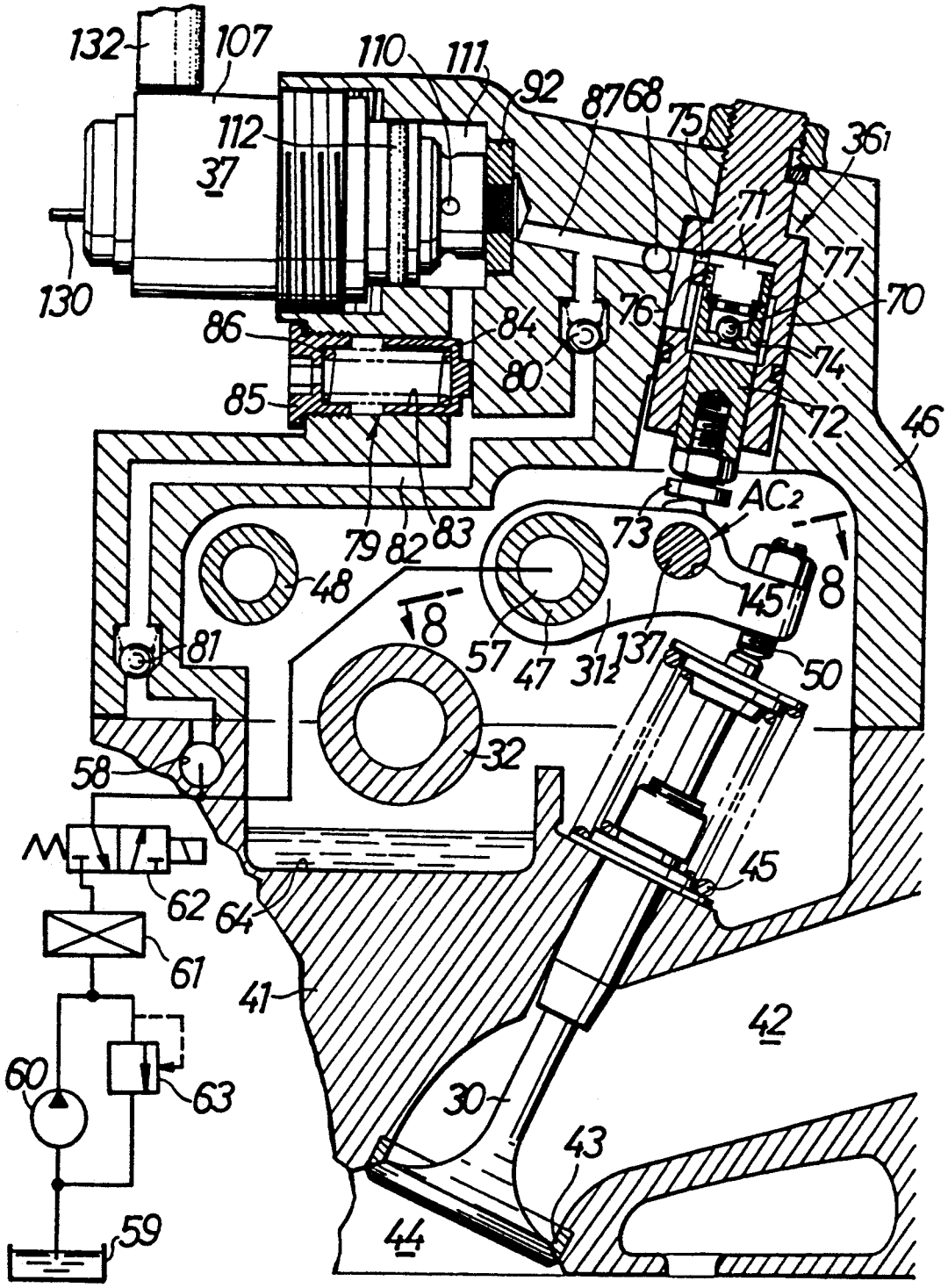

Referring to FIG. 5, the support block 46 is provided with a mounting hole 88 opened into an outer surface of a side thereof and having a horizontal axis for mounting of the hydraulic pressure releasing valve 37. The mounting hole 88 is comprised of, in sequence from an inner side in an axial direction thereof, a smaller diameter hole portion 89 and a larger diameter hole portion 90 larger in diameter than the smaller diameter hole portion 89, and a threaded hole portion 91 larger in diameter than the larger diameter hole portion 90, which hole portions 89, 90 and 91 are coaxially connected to one another. The oil passage 87 is provided in the support block 46, so that it is inclined upwardly toward the mounting hole 88. The uppermost end of the oil passage 87 is opened into a central portion of the smaller diameter hole portion 89. A filter 92 is received in the smaller diameter hole portion 89, so that it is flush with a step surface between the smaller and larger diameter hole portions 89 and 90. The oil passage 82 is opened into a side surface of the larger diameter hole portion 90 close to the smaller diameter hole portion 89. The oil passage 82 is provided in the support block 46 in such a manner that its opened end into the larger diameter hole portion 90 is the lowermost location.

The hydraulic pressure releasing valve 37 has a housing 94 which is comprised of a main housing body 95, a valve housing portion 96 provided at a front end of the main housing body 95, and a stationary core 97 mounted to a rear end of the main housing body 95. The main housing body 95 includes an outer cylindrical portion 98 which is smaller in diameter than the threaded hole portion 91, an inner cylindrical portion 99 coaxially disposed within the outer cylindrical portion 98, a connecting plate portion 100 interconnecting one end of each of the outer and inner cylindrical portions 98 and 99, a collar portion 101 protruding radially outwardly from that end of the outer cylindrical portion 98 and having an outside diameter slightly smaller than the inside diameter of the threaded hole portion 91, and a cylindrical connection 102 coaxially connected to the connecting plate portion 100 to extend in a reverse direction from the outer and inner cylindrical portions 98 and 99 and having an outside diameter small enough for fitting into the larger diameter hole portion 90. The axial length of the inner cylindrical portion 99 from the connecting plate portion 100 is set smaller than the axial length of the outer cylindrical portion 98 from the connecting plate portion 100.

The valve housing portion 96 is comprised of an outer cylindrical guide 103 and an inner cylindrical guide 104 coaxially disposed within the outer cylindrical guide 103, and is connected to a front end of the main housing body 95. The valve housing portion 96 is constructed with a tip end of the cylindrical connection 102 being crimped to the outer cylindrical guide 103 in a condition in which the outer and inner cylindrical guides 103 and 104 have been fitted into the cylindrical connection 102 in such a manner that the inner cylindrical guide 104 is abutted against the connecting plate portion 100. In addition, the stationary core 97 is fixed to a rear end of the outer cylindrical portion 98 by crimping.

Such housing 94 of the hydraulic pressure releasing valve 37 is inserted into the mounting hole 88 in such a manner that the cylindrical connection 102 of the main housing body 95 is fitted into the larger diameter hole portion 90, until the valve housing portion 96 of the housing 94 abuts against the filter 92. A front end of a cover 107 is threadedly engaged into the threaded hole portion 91 of the mounting hole 88, and the cover 107 is tightened, until a tip end thereof abuts against the collar 101 of the housing 94. This causes the housing 94 of the hydraulic pressure releasing valve 37 to be clamped and fixed between the cover 107 and the support block 46. The cover 107 has a hole 106 at a rear end thereof, which hole is closed by a lid 105 which is in the form of a cylindrical member covering a rear portion of the housing 94 and which is made of an insulating material. The rear portion of the housing 94 in the hydraulic pressure releasing valve 37 is covered with the cover 107, and an oil reservoir 108 is defined between the housing 94 and the cover 107.

An inlet port 109 is provided at one end of the outer cylindrical guide 103 of the valve housing portion 96 to lead to the oil passage 87 through the filter 92, and a plurality of circumferentially spaced apart outlet ports 110 are provided in a sidewall of the outer cylindrical guide 103 in the vicinity of the inlet port 109. An annular passage 111 is defined between an inner surface of the larger diameter hole portion 90 of the mounting hole 88 in the support block 46 and the outer cylindrical guide 103 to lead to the outlet ports 110 and the oil passage 82. An annular seal member 112 is fitted over an outer surface of the cylindrical connection 102 of the main housing portion 95 for serving a sealing between the annular passage 111 and the outside.

A bottomed cylindrically-shaped main valve member 113 is received in the valve housing portion 96, so that an outer surface thereof is in sliding contact with an inner surface of the outer cylindrical guide 103. The main valve member 113 is movable between a position in which it is seated on a tapered valve seat 114 provided on the outer cylindrical guide 103 to surround an inner end edge of the inlet port 109, thereby blocking the communication between the inlet and outlet ports 109 and 110, and a position in which it is moved away from the valve seat 114 to permit the communication between the inlet and outlet ports 109 and 110.

A back pressure chamber 115 is defined within the valve housing portion 96, so that a back of the main valve member 113 faces the back pressure chamber 115. A spring 116 is accommodated in the back pressure chamber 115 for exhibiting a spring force biasing the main valve member 113 in a direction for the latter to be seated on the valve seat 114. Thus, a hydraulic pressure in the inlet port 109 is applied to the main valve body 113 in a valve-opening direction, and a hydraulic pressure in the back pressure chamber 115 is applied to the main valve body 113 in a valve-closing direction, and the spring force of the spring 116 is also applied to the main valve body 113 in the valve-closing direction. A constriction 117 is provided in the main valve member 113 at a location offset from an axis of the main valve member 113 for permitting the communication between the inlet port 109 and the back pressure chamber 115.

The inner cylindrical guide 104 of the valve housing portion 96 is brought into abutment against the main valve body 113 during the opening operation of the main valve member 113 to function as a stopper. A pilot valve bore 118 is coaxially provided in that tip end of the inner cylindrical guide 104 which is opposed to the back of the main valve member 113. A pilot valve member 119 is slidably received in the inner cylindrical guide 104 and capable of closing the pilot valve bore 118. The pilot valve member 119 is biased in the valve-opening direction, i.e., in a retracting direction by means of a spring 120 which is interposed between the pilot valve member 119 and the valve housing portion 96. A communication passage 121 is coaxially provided in the pilot valve member 119 and adapted to be connected to the pilot valve bore 118, when the pilot valve member 119 is opened. The communication passage 121 is opened into a rear end of the pilot valve member 119.

A drive rod 123 is axially movably disposed in the inner cylindrical portion 99 of the main housing body 95 with a sleeve 122 interposed therebetween, so that a tip end of the drive rod 123 abuts against a rear end of the pilot valve member 119. A movable core 124 is axially movably disposed between an end of the inner cylindrical portion 99 and the stationary core 97. The drive rod 123 has a rear end coupled to the movable core 124. A spring 125 is mounted in a compressed manner between the movable core 124 and the stationary core 97, so that the movable core 124 is biased toward the inner cylindrical portion 99 by a spring force of the spring 125. Further, the drive rod 123 and the stationary core 97 are provided respectively with a communication passage 126 and a communication hole 127 for permitting the communication of the communication passage 121 with the oil reservoir 108.

A coil 129 taken up around a bobbin 128 is disposed between the outer and inner cylindrical portions 98 and 99 of the main housing body 95. A lead wire 130 connected to the coil 129 is drawn from the stationary core 97 via the oil reservoir 108 and through the lid 105 to the outside.

In such hydraulic pressure releasing valve 37, the energization of the coil 129 causes the movable core 124 and the drive rod 123 to be retracted against the spring force of the spring 125, while causing the pilot valve member 119 to be retracted in a manner to follow the drive rod 123, thereby allowing the pilot valve bore 118 to be opened. This permits the hydraulic pressure in the back pressure chamber 115 to be released, so that the balance in hydraulic pressure applied to the opposite surfaces of the main valve member 113 is lost, so that a valve-opening force provided by the hydraulic pressure in the inlet port 109 which is applied to a front surface of the main valve member 113 overcomes a valve-closing force provided by both the hydraulic pressure in the back pressure chamber 115 and the spring 116, whereby the main valve member 113 is operated to open the hydraulic pressure releasing valve 37. When the coil 129 is deenergized, the movable core 124 and the drive rod 123 are advanced by the spring force of the spring 125, and the pilot valve member 119 is advanced, until the pilot valve bore 118 is closed. This permits the hydraulic pressure in the inlet port 109 to be applied to the back pressure chamber 115 through the constriction 117, whereby the main valve member 113 is operated to close the hydraulic pressure releasing valve 37.

A connecting pipe 131 is mounted on a rear and upper portion of the cover 107 to lead to the oil reservoir 108, so that it is located above the end of the oil passage 87 adjacent the hydraulic pressure releasing valve 37 and above the end of the oil passage 82 adjacent the hydraulic pressure releasing valve 37. A flexible pipe line 132 is connected to the connecting pipe 131. The pipe line 132 is disposed so that it is bent upwardly at its intermediate portion into a substantially U-shaped fashion and opened at a location just above the oil bath 64.

With such hydraulic pressure releasing valve 37, the working oil can be filled around the main valve member 113, the pilot valve member 119 and the movable core 124, so that propagation of a collision sound due to the operation of the moving components to the outside is dampened by the surrounding oil. Moreover, the housing 94 is covered with the cover 107 defining the oil reservoir 108 between the cover 107 itself and the housing 94, and hence, even if the sound is leaked from the housing 94 to the outside, the sound is propagated through the oil in the oil reservoir 108 and thus dampened. Therefore, the noise released from the hydraulic pressure releasing valve 37 to the outside is largely reduced and hence, even if the frequency of operation of the hydraulic pressure releasing valve 37 is high, an effective reduction in noise can be achieved.

In the hydraulic pressure releasing valve 37, the oil reservoir 108 is located between the uppermost end locations of the oil passages 87 and 82 and defined inside the cover 107 to cover the housing 94 of the hydraulic pressure releasing valve 37 and is in communication with the inside of the hydraulic pressure releasing valve 37 through the communication hole 127 provided in the stationary core 97, and hence, an amount of oil corresponding to the amount of oil leaked through the hydraulic pressure paths such as the oil passages 82 and 87 can be replenished from the oil reservoir 108, thereby preventing the penetration of air into such hydraulic pressure paths to prevent an abnormal behavior from being produced due to the penetration of air.

Further, the housing 94 of the hydraulic pressure releasing valve 37 is clamped and fixed between the cover 107 and the support block 46, and the cover 107 has a function to define the reservoir 108 and a function to fix the housing 94, thereby making it possible to reduce the number of parts or components. Moreover, cuttings or the like can be prevented from penetrating the hydraulic pressure releasing valve 37. In a system of a structure in which the housing is threadedly engaged directly in the support block 46, it is difficult to consistently determine the position of the lead wire 130, whereas according to the present invention, it is easy to consistently determine the position of the lead wire 130.

The operation of the first embodiment will be described. When the introduction of the working oil having an extremely low temperature or an inappropriate viscosity results in an abnormally increased viscosity of the working oil, as well as when it is observed that an abnormal closing of the oil passage 68, 82, 87 or the like in the hydraulic transmitting means $T_{01}$, an abnormality of the pump 60 or the like has been produced, the communication between the pump 60 and the oil passage 58 is cut off by the solenoid switchover control valve 62, thereby reducing the hydraulic pressure in the oil passage 57, and the hydraulic pressure releasing valve 37 in the hydraulic transmitting means $T_{01}$ is left opened. By doing so, in the selective switchover means $AC_1$, the spring force of the spring 39 is exhibited to cause a position in which the connecting pin 38 extends over both the guide holes 51 and 52, so that the mechanical transmitting means $T_{M1}$ is brought into a state in which both the rocker arms $31_1$ and 34 are rigidly connected to each other by the connecting pin 38. In the hydraulic transmitting means $T_{01}$, the hydraulic pressure generated in the hydraulic pressure generating portion $35_1$ is absorbed by the accumulator 79 and as a result, a hydraulic pressure enough to drive the drive piston 72 is not introduced into the hydraulic pressure chamber 71 in the operating-force conversion portion $36_1$. Therefore, in a situation in which it is difficult to transmit the operating force by the hydraulic transmitting means $T_{01}$, the intake valve 30 is driven to be opened and closed by the mechanical transmission of the operating force from the operating-force generating means $P_{G1}$ to the drive rocker arm $31_1$ by the mechanical transmitting means $T_{M1}$.

When the temperature of the working oil is increased until the viscosity thereof becomes sufficiently low, or when the working oil having an appropriate viscosity is introduced, as well as when any abnormal closing of the oil passages 68, 82, 87 or the like in the hydraulic transmitting means $T_{01}$, any abnormality of the pump 60 or the like is not produced, the pump 60 and the oil passage 58 are put into communication with each other by the solenoid switchover control valve 62, thereby increasing the hydraulic pressure in the oil passage 57. By doing so, in the selective switchover means $AC_1$, the connecting pin 38 is forced into the guide hole 52 by an increased hydraulic pressure in the hydraulic pressure chamber 40, thereby releasing the connection of the rocker arms $31_1$ and 34 through the connecting pin 38 in the mechanical transmitting means $T_{M1}$. On the other hand, in the hydraulic transmitting means $T_{01}$, the hydraulic pressure generated in the hydraulic pressure generating portion $35_1$ is applied to the hydraulic pressure chamber 71 in the operating-force conversion portion $36_1$, so that the drive piston 72 is driven by the hydraulic pressure in the hydraulic pressure chamber 71. Therefore, no operating force is transmitted by the mechanical transmitting means $T_{M1}$, and the intake valve 30 is driven to be opened and closed by the transmission of the operating force by the hydraulic transmitting means $T_{01}$. In this case, the lift amount and closing timing for the intake valve 30 can be controlled by controlling the timing of release of the hydraulic pressure by the hydraulic pressure releasing valve 37 in the hydraulic transmitting means $T_{01}$.

A second embodiment of the present invention will now be described in connection with FIGS. 6 to 10. Components in this second and subsequent embodiments that are identical in construction and operation to components of the first embodiment will be identified by the same numeral and will not be described in detail again.

A valve operating system of the second embodiment comprises an operating-force generating means $P_{G2}$ for generating an operating force corresponding to the rotation of the engine, a drive rocker arm $31_2$ as an operating-force applying means for operating the intake valve 30, a hydraulic transmitting means $T_{02}$ capable of hydraulically transmitting the operating force from the operating-force generating means $P_{G2}$ to the drive rocker arm $31_2$, a mechanical transmitting means $T_{M2}$ capable of mechanically transmitting the operating force from the operating-force generating means $P_{G2}$ to the drive rocker arm $31_2$, a selective switchover means $AC_2$ capable of alternatively switching-over an input from the operating-force generating means $P_{G2}$ to the hydraulic transmitting means $T_{02}$ and an input from the operating-force generating means $P_{G2}$ to the mechanical transmitting means $T_{M2}$.

The operating-force generating means $P_{G2}$ is comprised of a cam 33 provided on the cam shaft 32, and a first free rocker arm 134 swingably driven by the cam 33. The hydraulic transmitting means $T_{02}$ comprises a hydraulic pressure generating portion $35_2$ for generating a hydraulic pressure in response to the operation of a second free rocker arm 135 capable of being connected to the first free rocker arm 134, an operating-force conversion portion $36_1$ for converting the hydraulic pressure from the hydraulic pressure generating portion $35_2$ into an operating force to transmit the latter to the drive rocker arm $31_2$, and a hydraulic pressure releasing valve 37 capable of releasing the hydraulic pressure in the operating-force conversion portion $36_1$. The mechanical transmitting means $T_{M2}$ comprises the drive rocker arm $31_2$ and the first free rocker arm 134 which are disposed adjacent each other, and a connecting pin 137. The connecting pin 137 is movable between a position in which it connects the first free rocker arm 134 and the drive rocker arm $31_2$ to each other and disconnects the first and second free rocker arms 134 and 135 from each other, and a position in which it disconnects the first free rocker arm 134 and the drive rocker arm $31_2$ from each other and connects the first and second free rocker arms 134 and 135 to each other. The selective switchover means $AC_2$ is constructed so that a biasing force in a direction to connect the first and second free rocker arms 134 and 135 by the hydraulic pressure in the hydraulic pressure chamber 40 is capable of being controlled for switchover between one of high and low levels and the other is applied to the connecting pin 137 which is biased by the spring 39 in a direction to connect the first free rocker arm 134 and the drive rocker arm $31_2$ to each other. The cam shaft 32 is integrally provided with a raised portion 136 formed into a true circle about the axis of the cam shaft 32, and the second free rocker arm 135 is in sliding contact with the raised portion 136 in a condition in which the connection thereof with the first free rocker arm 134 is released.

Figure 8:
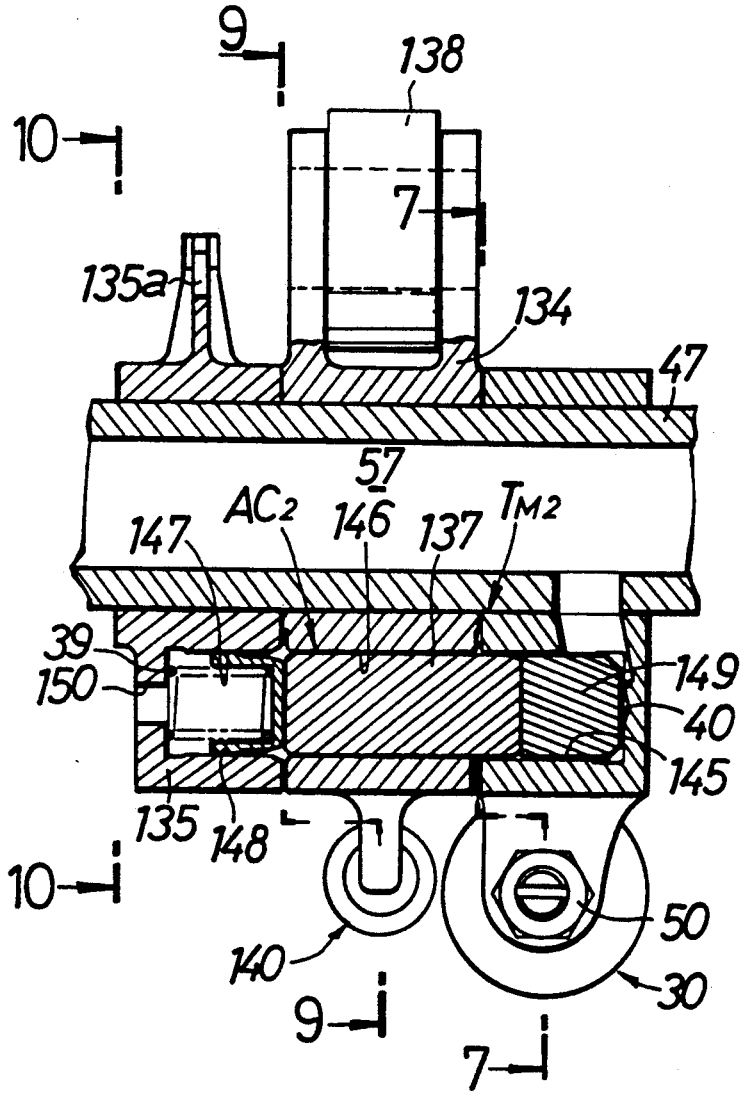

The drive rocker arm $31_2$, the first free rocker arm 134 and the second free rocker arm 135 are swingably carried on the intake-side rocker shaft 47 in such a manner that the drive rocker arm $31_2$ and the second free rocker arm 135 adjoin opposite sides of the first free rocker arm 134, as best shown in FIG. 8.

Figure 9:
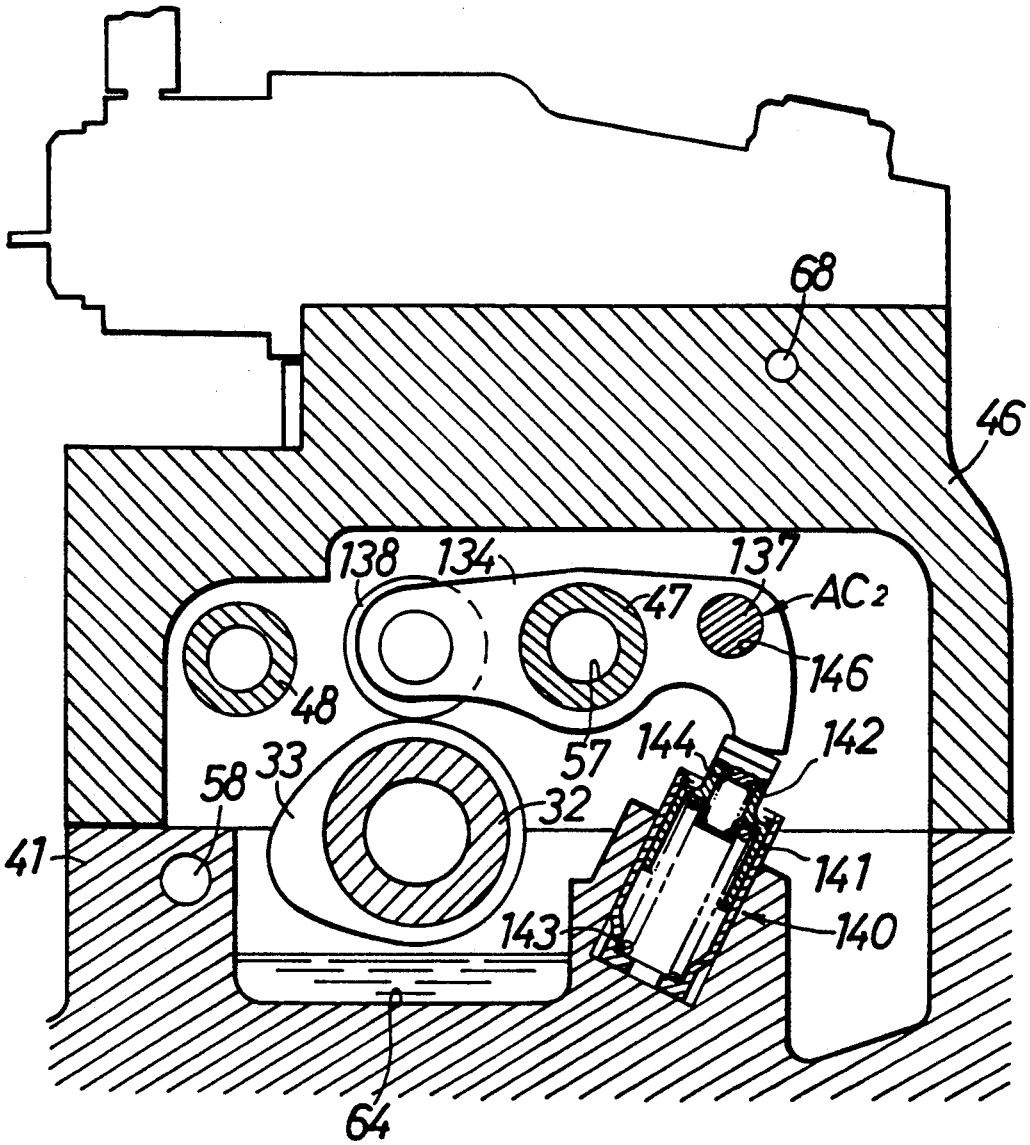

Referring also to FIG. 9, a roller 138 is carried by a pin on the first free rocker arm 134 constituting the operating-force generating means $P_{G2}$ to come into rolling contact with the cam 33. The first free rocker arm 134 is biased in a direction to bring the roller 138 into rolling contact with the cam 33 by a resilient biasing means 140 mounted in the cylinder head 41. Thus, the first free rocker arm 134 is swung with a characteristic corresponding to the shape of the cam 33 by the rotation of the shaft 32 corresponding to the revolution of the engine.

The resilient biasing means 140 comprises a bottomed cylindrical guide 141 fixedly fitted in the upper portion of the cylinder head 41, a lifter 142 slidably received in the cylindrical guide 141 and having an upper end abutting against the first free rocker arm 134, and a pair of springs 143 and 144 interposed in series between a closed end of the cylindrical guide 141 and the lifter 142.

The drive rocker arm $31_2$ swingably carried on the intake-side rocker shaft 47 adjacent the first free rocker arm 134 is operatively connected to the intake valve 30 through a tappet screw. A bottomed guide hole 145 is provided in the drive rocker arm $31_2$ in parallel to the intake-side rocker shaft 47 and opened toward the first free rocker arm 134. A guide hole 146 corresponding to the guide hole 145 is provided in the first free rocker arm 134 in parallel to the rocker shaft 47 to extend between opposite side surfaces thereof. A bottomed guide hole 147 is provided in the second free rocker arm 135 in parallel to the rocker shaft 47 at a location corresponding to the guide hole 146 and opened toward the first free rocker arm 134.

The connecting pin 137 constituting the mechanical transmitting means $T_{M2}$ together with the drive rocker arm $31_2$ and the first free rocker arm 134 is slidably received in the guide hole 146 for movement between a position (shown in FIGS. 6 and 8) in which it is fitted into both the guide holes 145 and 146 to rigidly connect the drive rocker arm $31_2$ and the first free rocker arm 134, and a position in which it is fitted into both the guide holes 146 and 147 to disconnect the first free rocker arm 134 from the drive rocker arm $31_2$, but to rigidly connect the first free rocker arm 134 and the second free rocker arm 135 to each other.

The selective switchover means $AC_2$ includes a restraining member 148, the spring 39, and a switchover piston 149. The restraining member 148 is formed into a bottomed cylindrical shape and slidably received in the guide hole 147 to abut against one end of the connecting pin 137. The spring 39 is mounted in a compressed manner between a closed end of the guide hole 147 and the restraining member 148. The switchover piston 149 is slidably received in the guide hole 145 to abut against the other end of the connecting pin 137 and to define a hydraulic pressure chamber 40 between the switchover piston 149 itself and a closed end of the guide hole 145. An opened aperture 150 is provided in the closed end of the guide hole 147. The hydraulic pressure chamber 40 normally communicates with the hydraulic pressure passage 57 in the intake-side rocker shaft 47.

In such selective switchover means $AC_2$, the axial length of each of the connecting pin 137, the restraining member 148 and the switchover piston 149 is set so that the connecting pin 137 is received into both the guide holes 146 and 145 and the abutment surfaces of the connecting pin 137 and the restraining member 148 are located between the opposed surface of the first and second free rocker arms 134 and 135 in a condition in Which the switchover piston 149 has been moved to the maximum in a direction to reduce the volume of the hydraulic pressure chamber 40, and so that the abutment surfaces of the connecting pin 137 and the switchover piston 149 is located between the opposed surfaces of the drive rocker arm $31_2$ and the first free rocker arm 134 and the connecting pin 137 is received into both the guide holes 146 and 147 in a condition in which the restraining member 148 has been moved to a position to abut against the closed end of the guide hole 147.

Figure 10:
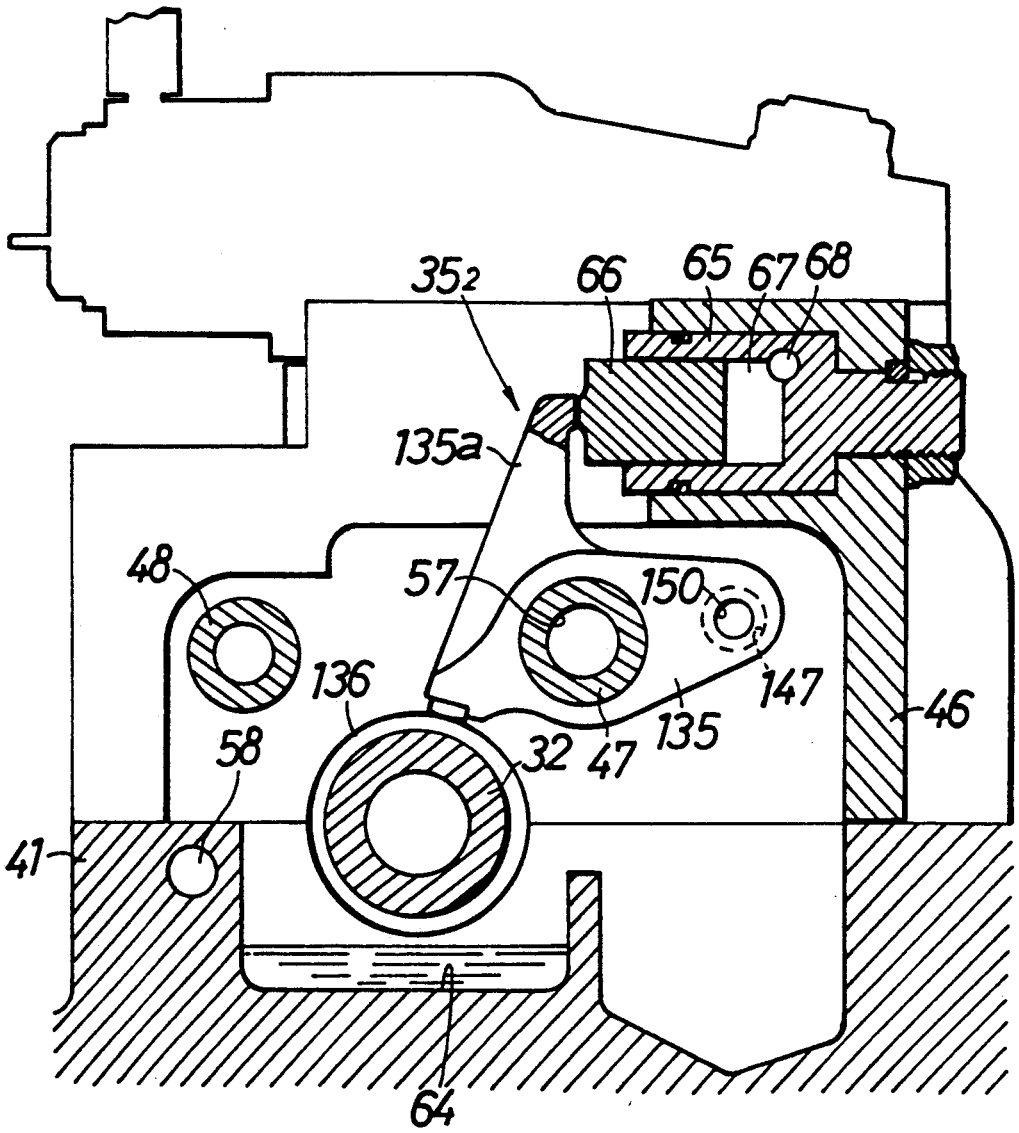

Referring to FIG. 10, the hydraulic pressure generating portion $35_2$ in the hydraulic pressure transmitting means $T_{02}$ is comprised of the second free rocker arm 135, a first cylinder 65 fixed in the support block 46, and a follower piston 66 slidably received in the first cylinder 65. The follower piston 66 is in sliding contact with an urging portion integrally provided on the second free rocker arm 135 and defines a hydraulic pressure generating chamber 67 between the follower piston 66 itself and the first cylinder 65. Thus, the follower piston 66 is slidably driven by the second free rocker arm 135 swingably driven by the cam 33 upon connection with the first rocker arm 134, thereby generating a hydraulic pressure in the hydraulic pressure generating chamber 67.

The drive piston 72 of the operating-force conversion portion $36_1$ in the hydraulic transmitting means $T_{02}$ is operatively connected to the drive rocker arm $31_2$. As in the hydraulic transmitting means $T_{01}$ in the first embodiment, a hydraulic pressure releasing valve 37, an accumulator 79, a one-way valve 80 and a check valve 81 are disposed in the support block 46.

The operation of the second embodiment will be described. When the introduction of the working oil having an extremely low temperature or an inappropriate viscosity, or the like, results in an abnormally increased viscosity of the working oil, as well as when it is observed that an abnormal closing of the oil passage 68, 82, 87 or the like in the hydraulic transmitting means $T_{02}$ and an abnormality of the pump 60 has been produced, the communication between the pump 60 and the oil passage 58 is cut off by the solenoid switchover control valve 62, thereby reducing the hydraulic pressure in the oil passage 57, and the hydraulic pressure releasing valve 37 is left opened. By doing so, in the selective switchover means $AC_2$, the spring force of the spring 39 is exhibited to cause a position in which the connecting pin 137 extends over both the guide holes 145 and 146, so that the mechanical transmitting means $T_{M2}$ is brought into a state in which both the rocker arms $31_2$ and 134 are rigidly connected to each other by the connecting pin 137. On the other hand, the selective switchover means $AC_2$ is in a state in which the first and second free rocker arms 134 and 135 are disconnected from each other, and the second free rocker arm 135 remains stationary in abutment against the raised portion 136, so that any hydraulic pressure cannot be generated in the hydraulic pressure generating chamber $35_2$. Therefore, no operating force is transmitted by the hydraulic pressure transmitting means $T_{02}$. Moreover, the hydraulic pressure releasing valve 37 is in its opened state and hence, operation of the drive piston 72 to follow the opening and closing operation of the intake valve 30 is avoided completely. As a result, the intake valve 30 is driven to be opened and closed by mechanically transmitting the operating force from the operating-force generating means $P_{G2}$ to the drive rocker arm $31_2$ by the mechanical transmitting means $T_{M2}$.

When the temperature of the working oil is increased until the viscosity thereof becomes sufficiently low, or when working oil having an appropriate viscosity is introduced, as well as when any abnormal closing of the oil passages 68, 82, 87 or the like in the hydraulic transmitting means $T_{02}$ or any abnormality of the pump 60 is not produced, the pump 60 and the oil passage 58 are put into communication with each other by the solenoid switchover control valve 62, thereby increasing the hydraulic pressure in the oil passage 57. By doing so, in the selective switchover means $AC_2$, the connecting pin 137 is caused to be moved, until it is received into the guide hole 147 with its abutment surface against the switchover piston 149 being located between the opposed surfaces of the drive rocker arm $31_2$ and the first free rocker arm 134, so that the mechanical transmitting means $T_{M2}$ is brought into a state in which the connection through the connecting pin 137 is released. On the other hand, in the hydraulic pressure transmitting means $T_{01}$, the second free rocker arm 135 is swingably driven by connection with the first free rocker arm 134, thereby permitting the hydraulic pressure generated in the hydraulic pressure generating portion $35_2$ to be applied to the hydraulic pressure chamber 71 in the operating-force conversion portion $36_1$, so that the drive piston 72 is driven by the hydraulic pressure in the hydraulic pressure chamber 71. Therefore, no operating force is transmitted by the mechanical transmitting means $T_{M2}$, and the intake valve 30 is driven to be opened and closed by the transmission of the operating force by the hydraulic transmitting means $T_{02}$. In this case, the lift amount of and the closing timing for the intake valve 30 can be controlled by controlling the timing of release of the hydraulic pressure by the hydraulic pressure releasing valve 37 in the hydraulic transmitting means $T_{02}$.

A third embodiment of the present invention will now be described in connection with FIGS. 11 to 15.

Figure 11:
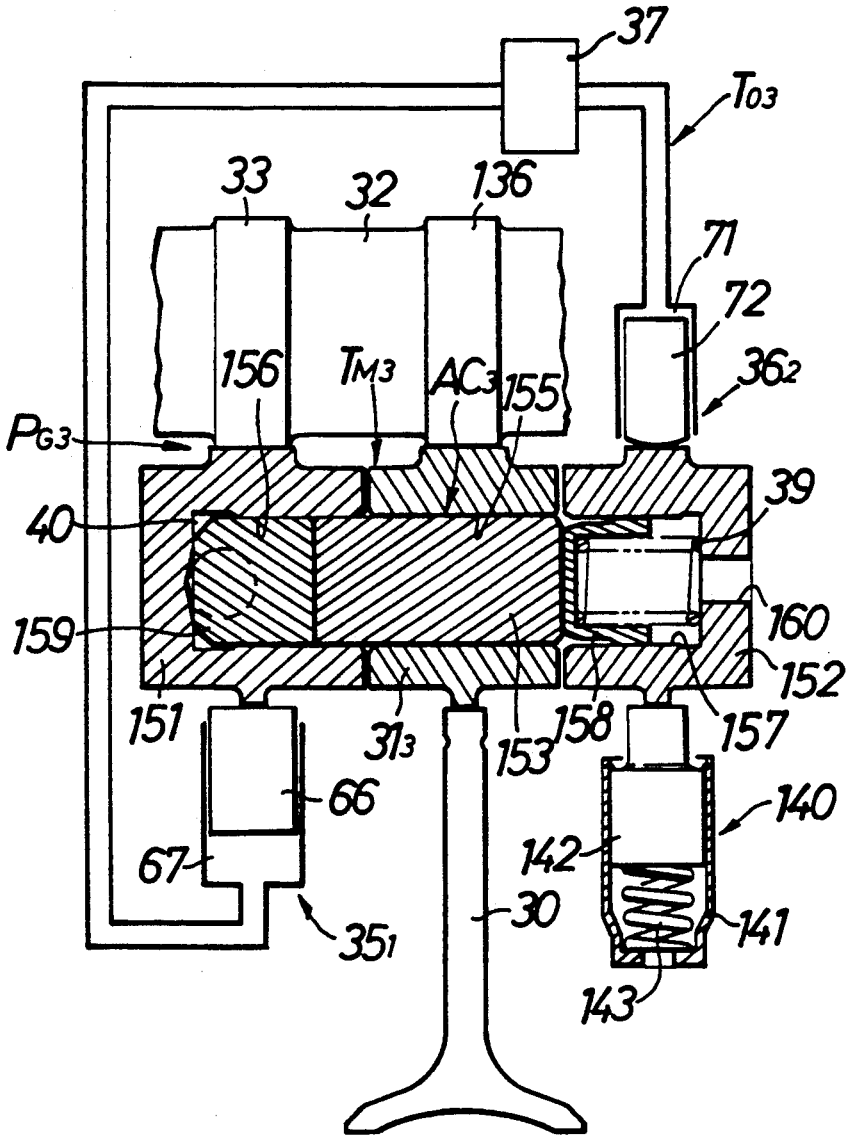
Figure 12:
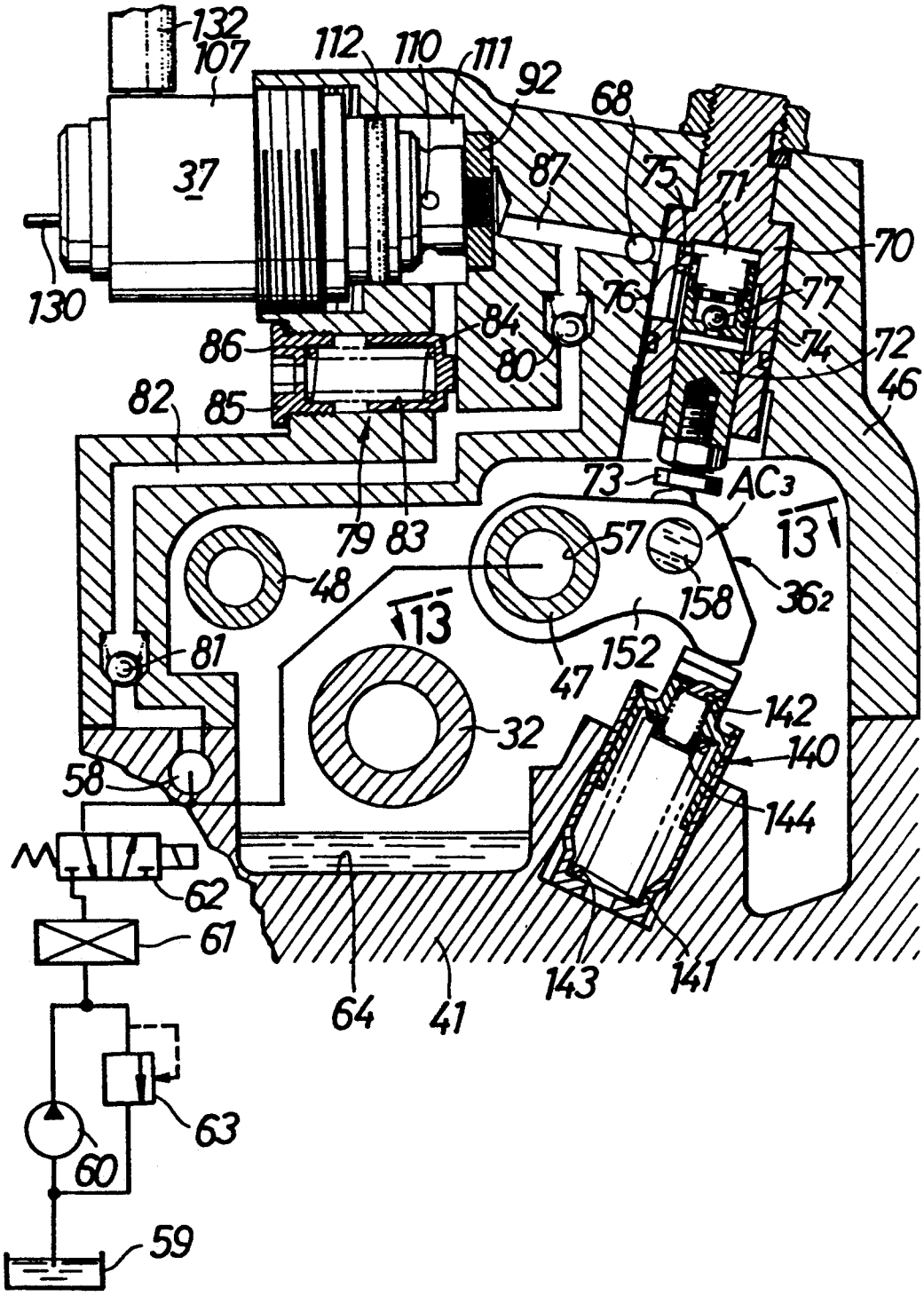

Referring to FIG. 11, a valve operating system of this embodiment comprises an operating-force generating means $P_{G3}$ for generating an operating force corresponding to the rotation of the engine, a drive rocker arm $31_3$ as an operating-force applying means for operating the intake valve 30, a hydraulic transmitting means $T_{03}$ capable of hydraulically transmitting the operating force from the operating-force generating means $P_{G3}$ to the drive rocker arm $31_3$, a mechanical transmitting means $T_{M3}$ capable of mechanically transmitting the operating force from the operating-force generating means $P_{G3}$ to the drive rocker arm $31_3$, and a selective switchcover means $AC_3$ capable of alternatively switching-over, from one to another, an output from the hydraulic transmitting means $T_{03}$ to the drive rocker arm $31_3$ and an output from the mechanical transmitting means $T_{M3}$ to the drive rocker arm $31_3$.

The operating-force generating means $P_{G3}$ comprises a cam 33 provided on a cam shaft 32, and a first free rocker arm 151 swingably driven by the cam 33. The hydraulic transmitting means $T_{03}$ comprises a hydraulic pressure generating portion $35_1$ for generating a hydraulic pressure corresponding to the operation of the first free rocker arm 151, an operating-force conversion portion $36_2$ constructed with a second free rocker arm 152 being as a component disposed adjacent the drive rocker arm $31_3$ for converting the hydraulic pressure from the hydraulic pressure generating portion $35_1$ into an operating force to transmit it to the intake valve 30, and a hydraulic pressure releasing valve 37 capable of releasing the hydraulic pressure in the operating-force conversion portion $36_2$. The mechanical transmitting means $T_{M3}$ comprises the drive rocker arm $31_3$ and the first free rocker arm 151 which are disposed adjacent each other, and a connecting pin 153. The connecting pin 153 is movable between a position in which it connects the drive rocker arm $31_3$ and the first free rocker arm 151 to each other and disconnects the drive rocker arm $31_3$ and the second free rocker arm 152 from each other and a position in which it disconnects the drive rocker arm $31_3$ and the first free rocker arm 151 and connects the drive rocker arm $31_3$ and the second free rocker arm 152 to each other. The selective switchover means $AC_3$ is constructed so that a biasing force in a direction to disconnect the drive rocker arm $31_3$ and the first free rocker arm 151 from each other and connect the drive rocker arm $31_3$ and the second free rocker arm 152 to each other is produced by the hydraulic pressure in the hydraulic pressure chamber 40 which is capable of being controlled for switchover between one of high and low levels and the other is applied to the connecting pin 153 biased by the spring 39 in a direction to connect the drive rocker arm $31_3$ and the first free rocker arm 151 to each other and disconnect the drive rocker arm $31_3$ and the second free rocker arm 152 from each other.

Figure 13:
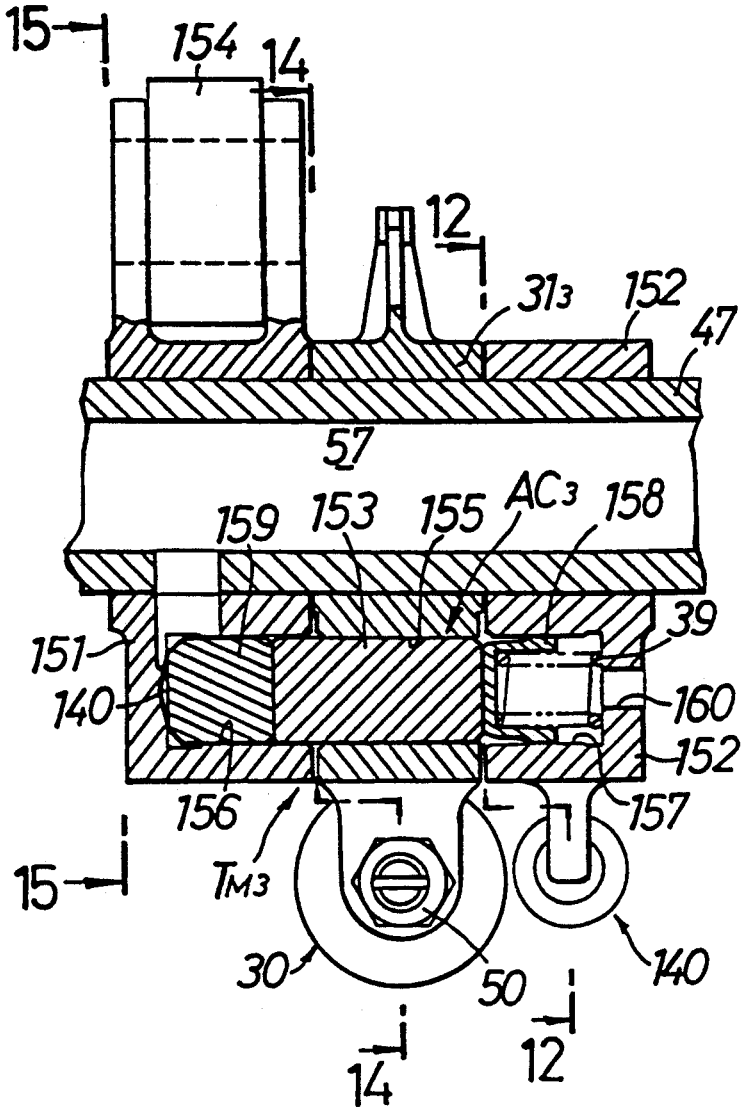
Figure 14:
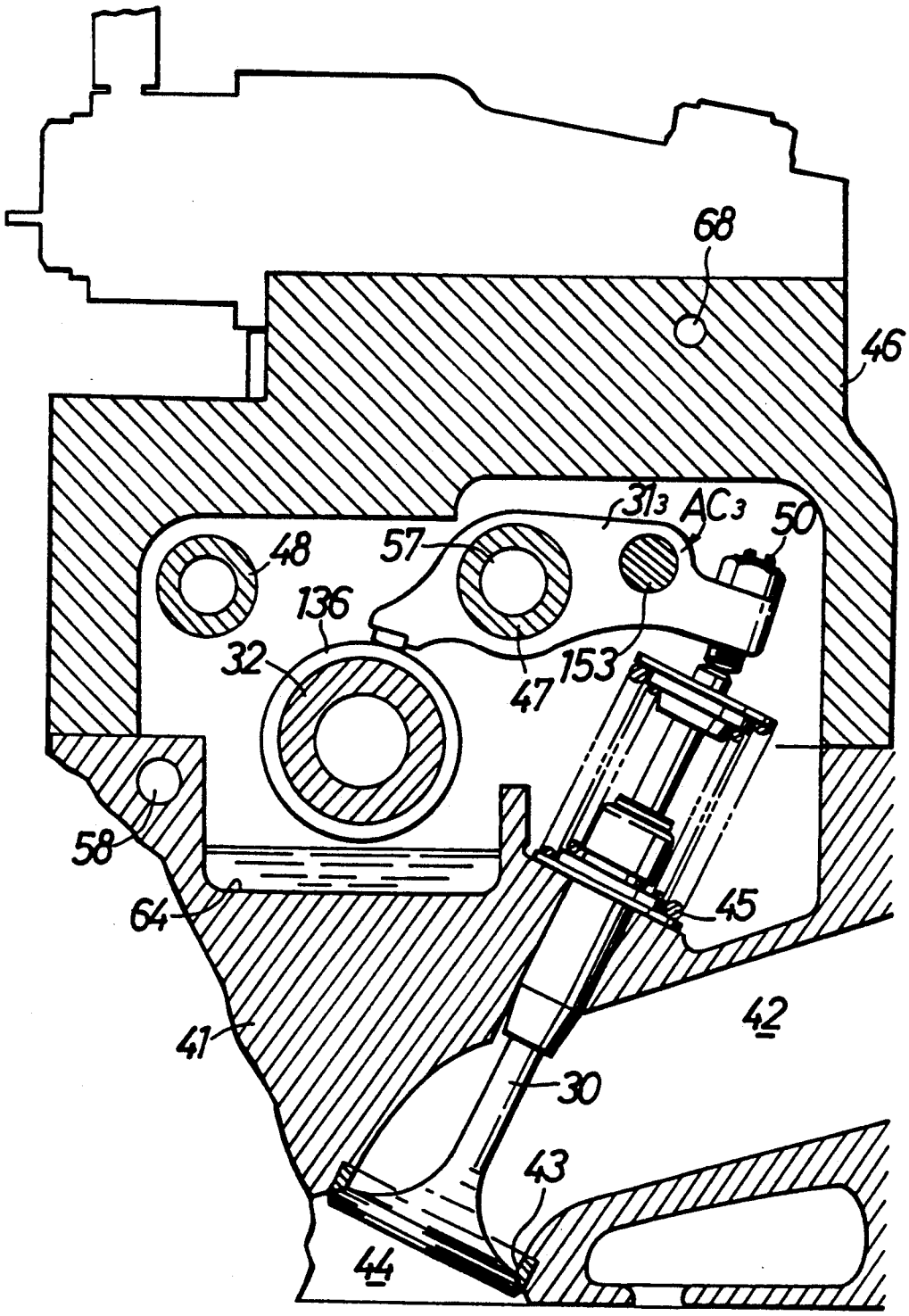

As best shown in FIG. 13, the drive rocker arm $31_3$, the first free rocker arm 151 and the second free rocker arm 152 are swingably carried on the intake-side rocker shaft 47, so that the first and second free rocker arms 151 and 152 adjoin opposite sides of the drive rocker arm $31_3$.

Figure 15:
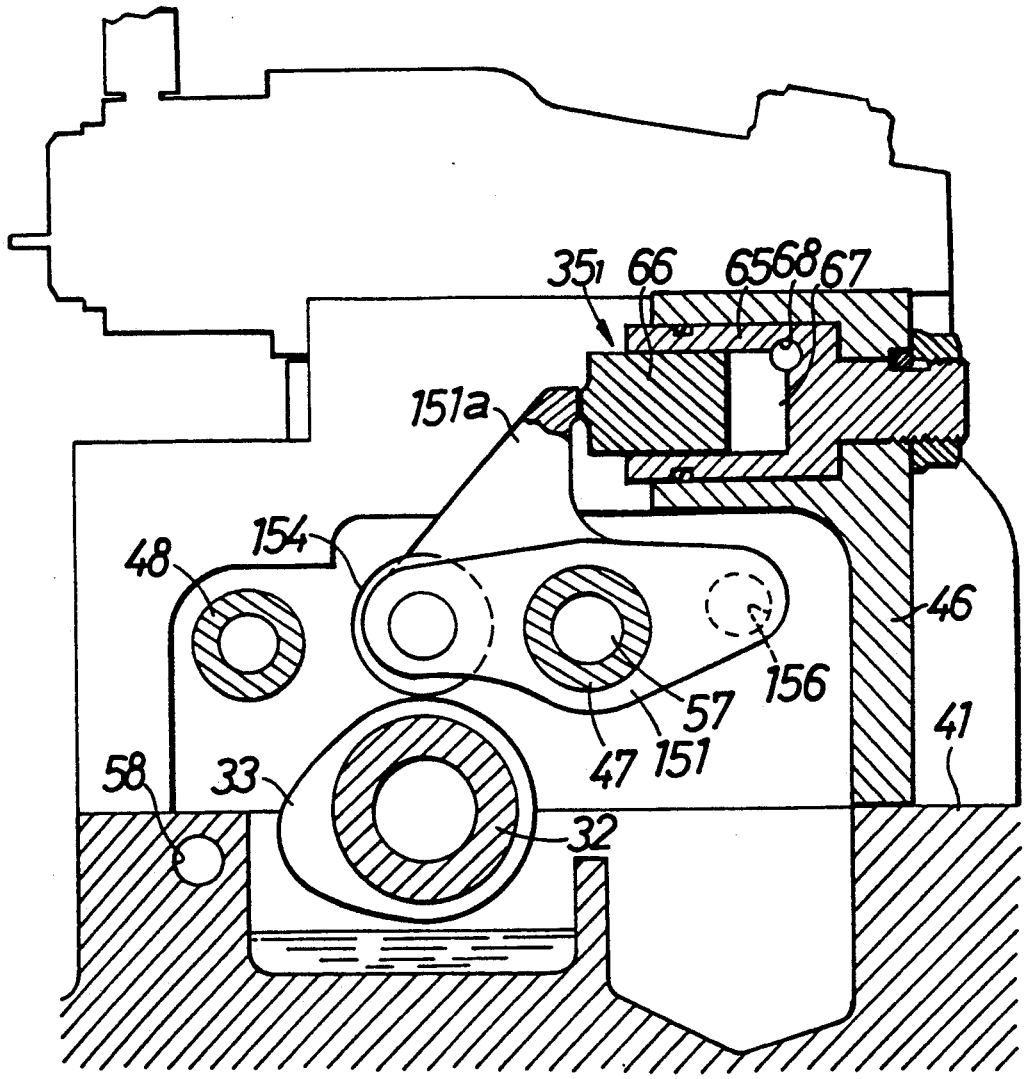

Referring also to the FIG. 15, a roller 154 is carried by a pin on the first free rocker arm 151 constituting the operating-force generating means $P_{G3}$ to come into rolling contact with the cam 33. Thus, the first free rocker arm 151 is swung with a characteristic corresponding to the shape of the cam 33 by the rotation of the cam shaft 32 corresponding to the revolution of the engine.

The drive rocker arm $31_3$ swingably carried on the intake-side rocker shaft 47 is operatively connected to the intake valve 30 through a tappet screw 50 and is in sliding contact with a circular raised portion 136 provided on the cam shaft 32. A guide hole 155 is provided in the drive rocker arm $31_3$ in parallel to the intake-side rocker shaft 47 and opened to the opposite first and second free rocker arms 151 and 152. A bottomed guide hole 156 corresponding to the guide hole 155 is provided in the first free rocker arm 151 in parallel to the rocker shaft 147 and opened to the drive rocker arm $31_3$. A bottomed guide hole 157 is provided in the second free rocker arm 152 in parallel to the rocker shaft 147 at a location corresponding to the guide hole 155 and is opened to the drive rocker arm $31_3$.

The connecting pin 153 constituting the mechanical transmitting means $T_{M3}$ together with the drive rocker arm $31_3$ and the first free rocker arm 151 is slidably received in the guide hole 155 for movement between a position (shown in FIGS. 11 and 13) in which it is fitted into both the guide holes 155 and 156 to ridigly connect the drive rocker arm $31_3$ and the first free rocker arm 151 to each other, but to disconnect the drive rocker arm $31_3$ and the second free rocker arm 152 from each other, and a position in which it is fitted into both the guide holes 155 and 157 to disconnect the drive rocker arm $31_3$ and the first free rocker arm 151 from each other, but to rigidly connect the drive rocker arm $31_3$ and the second free rocker arm 152 to each other.

The selective switchover means $AC_3$ includes a restraining member 158, a spring 39 and a switchover piston 159. The restraining member 158 is formed into a bottomed cylindrical shape and is slidably received in the guide hole 157 to abut against one end of the connecting pin 153. The spring 39 is mounted in a compressed manner between a closed end of the guide hole 157 and the restraining member 158. The switchover piston 159 is slidably received in the guide hole 156 to abut against the other end of the connecting pin 153 and to define a hydraulic pressure chamber 40 between the piston 159 itself and a closed end of the guide hole 156. An opened aperture 160 is provided in the closed end of the guide hole 157. The hydraulic pressure chamber 40 normally communicates with the hydraulic pressure passage 57 in the intake-side rocker shaft 47.

In such selective switchover means $AC_3$, the axial length of each of the connecting pin 153, the restraining member 158 and the switchover piston 159 is set so that the connecting pin 153 is received into both the guide holes 155 and 156 and the abutment surfaces of the connecting pin 153 and the restraining member 158 are located between the opposed surface of the drive rocker arm $31_3$ and the second free rocker arm 152 in a condition in which the switchover piston 159 has been moved to the maximum in a direction to reduce the volume of the hydraulic pressure chamber 40, and so that the abutment surfaces of the connecting pin 153 and the switchover piston 159 are located between the opposed surfaces of the drive rocker arm $31_3$ and the first free rocker arm 151 and the connecting pin 153 is received into both the guide holes 155 and 157 in a condition in which the restraining member 158 has been moved to a position in Which it has abutted against the closed end of the guide hole 157.

In the hydraulic transmitting means $T_{03}$, the hydraulic pressure generating portion $35_1$ is disposed in the support block 46, so that the follower piston 66 is brought into sliding contact with an urging portion 151*a* integrally provided on the first free rocker arm 151. The follower piston 66 is slidably driven by the first free rocker arm 151, thereby generating a hydraulic pressure in the hydraulic pressure generating chamber 67.

The operating-force conversion portion $36_2$ in the hydraulic transmitting means $T_{03}$ comprises a second cylinder 70 fixed in the support block 46, a drive piston 72 slidably received in the second cylinder 70 to define a hydraulic pressure chamber 71 between the piston 72 itself and the second cylinder 70, and the second free rocker arm 152 operatively connected to the drive piston 72.

The structure with respect to the second cylinder 70 and the drive piston 72 is similar to those in the first and second embodiments. In addition, a hydraulic pressure releasing valve 37, an accumulator 79, a one-way valve 80 and a check valve 81 are disposed in the support block 46, as in the first and second embodiments.

The operation of the third embodiment will be described. When the introduction of the working oil having an extremely low temperature or an inappropriate viscosity, or the like, results in an abnormally increased viscosity of the working oil, as well as when it is observed that an abnormal closing of the oil passage 68, 82, 87 or the like in the hydraulic transmitting means $T_{03}$, an abnormality of the pump 60, or the like has been produced, the communication between the pump 60 and the oil passage 58 is cut off by the solenoid switchover control valve 62, thereby reducing the hydraulic pressure in the oil passage 57. By doing so, in the selective switchover means $AC_3$, the spring force of the spring 39 is exhibited to cause a position in which the connecting pin 153 extends over both the guide holes 155 and 156, so that the mechanical transmitting means $T_{M3}$ is brought into a state in which both the drive rocker arms $31_3$ and the first free rocker arm 151 are rigidly connected to each other by the connecting pin 153. On the other hand, the selective switchover means $AC_3$ is in such a state in which the second free rocker arm 152 and the drive rocker arm $31_3$ are disconnected from each other, so that the operating-force conversion portion $36_2$ and drive rocker arm $31_3$ are disconnected. Therefore, no operating force is transmitted by the hydraulic pressure transmitting means $T_{03}$. As a result, the intake valve 30 is driven to be opened and closed by the mechanical transmission of the operating force from the operating-force generating means $P_{G3}$ to the drive rocker arm $31_3$ by the mechanical transmitting means $T_{M3}$. In this case, the avoidance of the failure of returning movement of the drive piston 72 and a reduction in frictional resistance to the drive piston 72 can be achieved by maintaining the opened state of the hydraulic pressure releasing valve 37 in the hydraulic transmitting means $T_{03}$ and the discontinuance of the operation of the drive piston 72.

When the temperature of the working oil is increased until the viscosity thereof becomes sufficiently low, or when the working oil having an appropriate viscosity is introduced, as well as when any abnormal closing of the oil passages 68, 82, 87 or the like in the hydraulic transmitting means $T_{03}$ or any abnormality of the pump 60 is not produced, the pump 60 and the oil passage 58 are put into communication with each other by the solenoid switchover control valve 62, thereby increasing the hydraulic pressure in the oil passage 57. By doing so, in the selective switchover means $AC_3$, the connecting pin 153 is caused to be moved, until it is received into the guide hole 157 with its abutment surface against the switchover piston 159 being located between the opposed surfaces of the drive rocker arm $31_3$ and the first free rocker arm 151, so that the mechanical transmitting means $T_{M3}$ is brought into a state in which the rigid connection through the connecting pin 153 is released. On the other hand, in the hydraulic transmitting means $T_{03}$, the second free rocker arm 152 is connected to the drive rocker arm $31_3$, thereby causing the hydraulic pressure generated in the hydraulic pressure generating portion $35_1$ to be converted into an operating force in the operating-force conversion portion $36_2$, which is then applied to the drive rocker arm $31_3$. Therefore, no operating force is transmitted by the mechanical transmitting means $T_{M3}$, and the intake valve 30 is driven to be opened and closed by the transmission of the operating force by the hydraulic transmitting means $T_{03}$. In this case, the lift amount of and the closing timing for the intake valve 30 can be controlled by controlling the timing of release of the hydraulic pressure by the hydraulic pressure releasing valve 37 in the hydraulic transmitting means $T_{03}$.

A fourth embodiment of the present invention will be described in connection with FIGS. 16 to 21.

Figure 16:
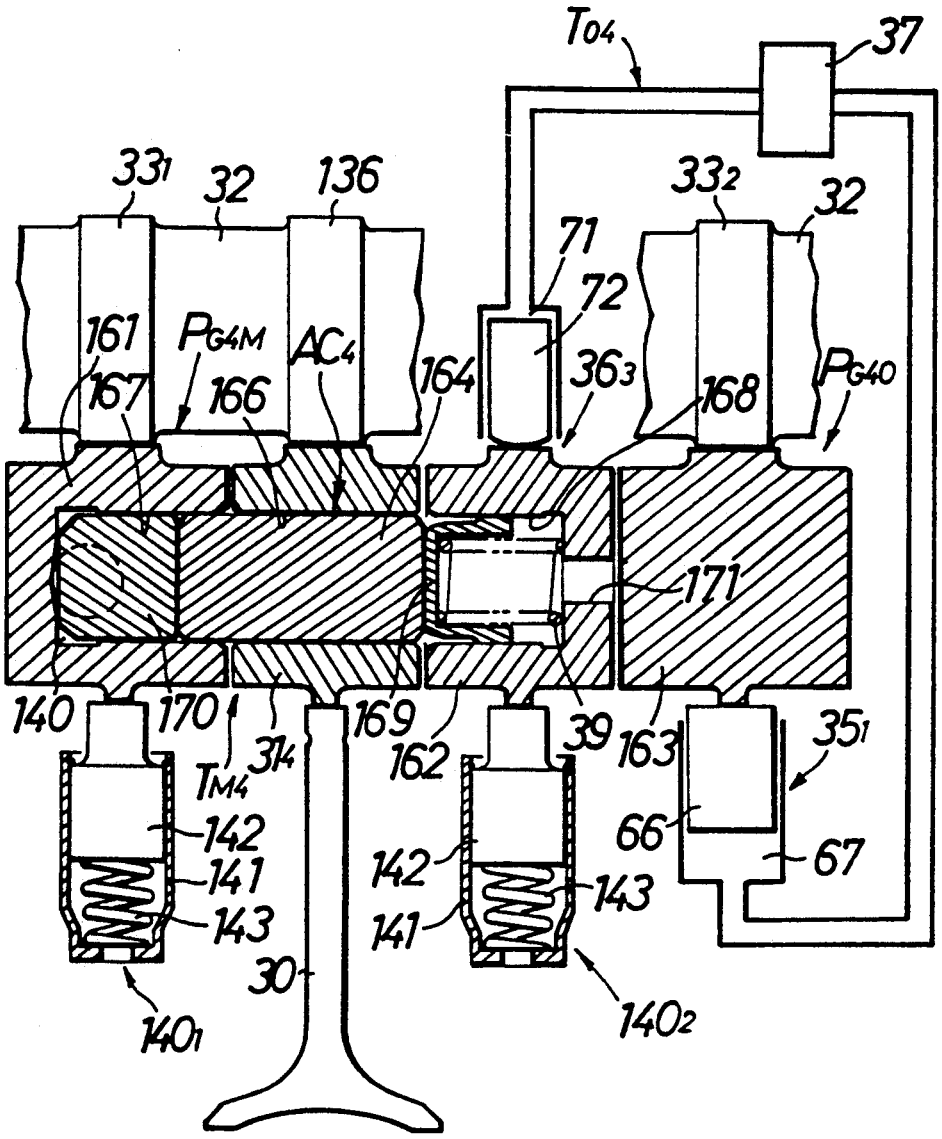
Figure 17:
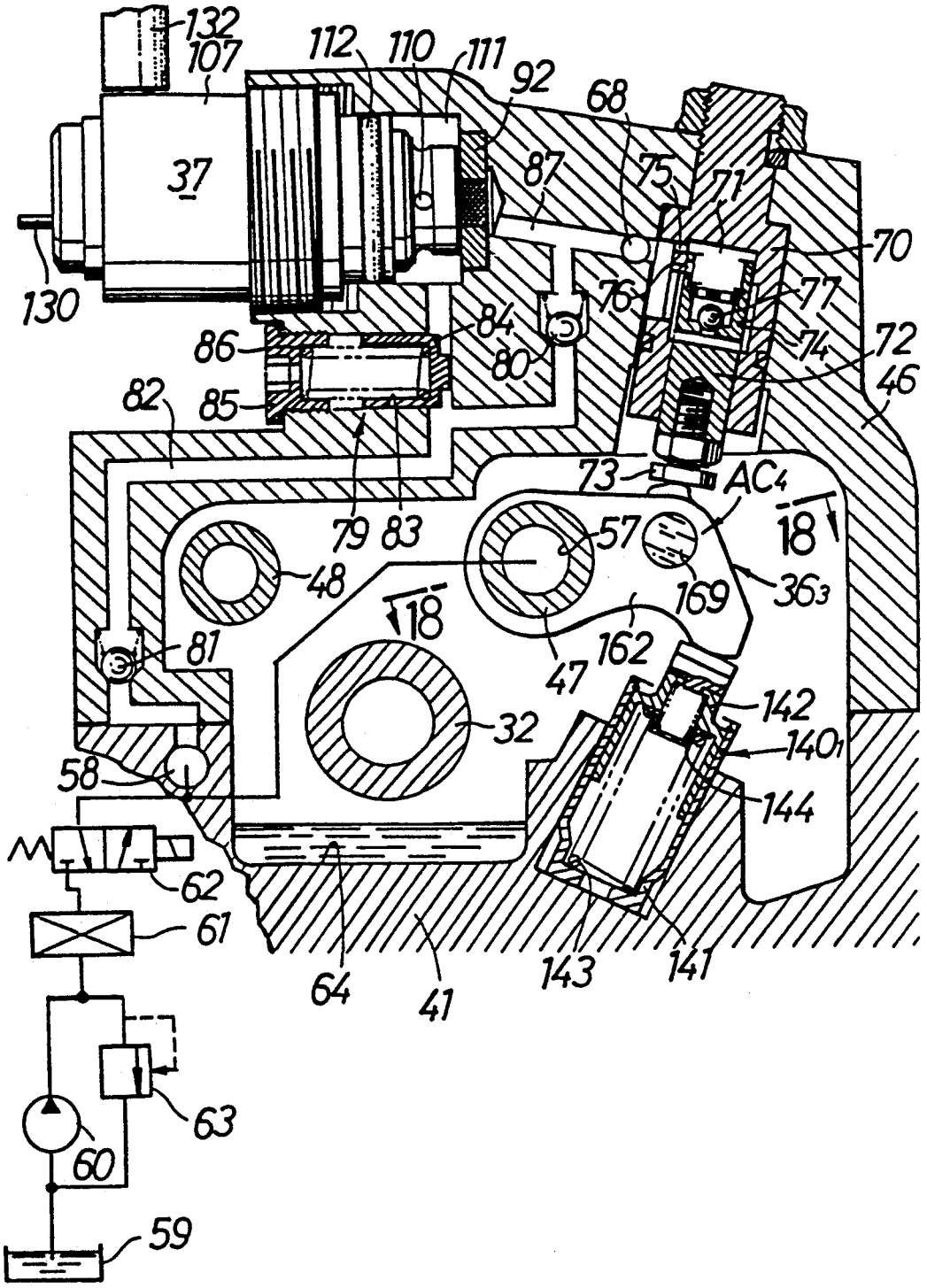

Referring to FIG. 16, a valve operating system of this embodiment comprises a mechanical transmission operating-force generating means $P_{G4M}$ and a hydraulic transmission operating-force generating means $P_{G4O}$ for generating an operating force corresponding to the revolution of the engine, a drive rocker arm $31_4$ as an operating-force applying means for operating the intake valve 30, a hydraulic transmitting means $T_{04}$ capable of hydraulically transmitting the operating force from the hydraulic transmission operating-force generating means $P_{G4O}$ to the drive rocker arm $31_4$, a mechanical transmitting means $T_{M4}$ capable of mechanically transmitting the operating force from the mechanical transmission operating-force generating means $P_{G4M}$ to the drive rocker arm $31_4$, and a selective switchover means $AC_4$ capable of alternatively switching-over, from one to another, an output from the hydraulic transmitting means $T_{04}$ to the drive rocker arm $31_4$ and an output from the mechanical transmitting means $T_{M4}$ to the drive rocker arm $31_4$.

The mechanical transmission operating-force generating means $P_{G4M}$ is comprised of a cam $33_1$ provided on a cam shaft 32, and a first free rocker arm 161 swingably driven by the cam $33_1$. The hydraulic transmission operating-force generating means $P_{G4O}$ is comprised of a cam $33_2$ provided on the cam shaft 32, and a plunger rocker arm 163 driven by the cam $33_2$. The hydraulic transmitting means $T_{04}$ comprises the drive rocker arm $31_4$ and the first free rocker arm 161 which are disposed adjacent each other, and a connecting pin 164 which is movable between a position in which it connects the drive rocker arm $31_4$ and the first free rocker arm 161 to each other and disconnects the drive rocker arm $31_4$ and the second free rocker arm 162 from each other, and a position in which it disconnects the drive rocker arm $31_4$ and the first free rocker arm 161 from each other and connects the drive rocker arm $31_4$ and the second free rocker arm 162 to each other. The selective switchover means $AC_4$ is constructed so that a biasing force in a direction to disconnect the drive rocker arm $31_4$ and the first free rocker arm 161 from each other and connect the drive rocker arm $31_4$ and the second free rocker arm 162 to each other is produced by the hydraulic pressure in the hydraulic pressure chamber 40 which is capable of being controlled for switchover between one of high and low levels and the other is applied to the connecting pin 164 biased by the spring 39 in a direction to connect the drive rocker arm $31_4$ and the first free rocker arm 161 to each other and disconnect the drive rocker arm $31_4$ and the second free rocker arm 162 from each other.

Figure 18:
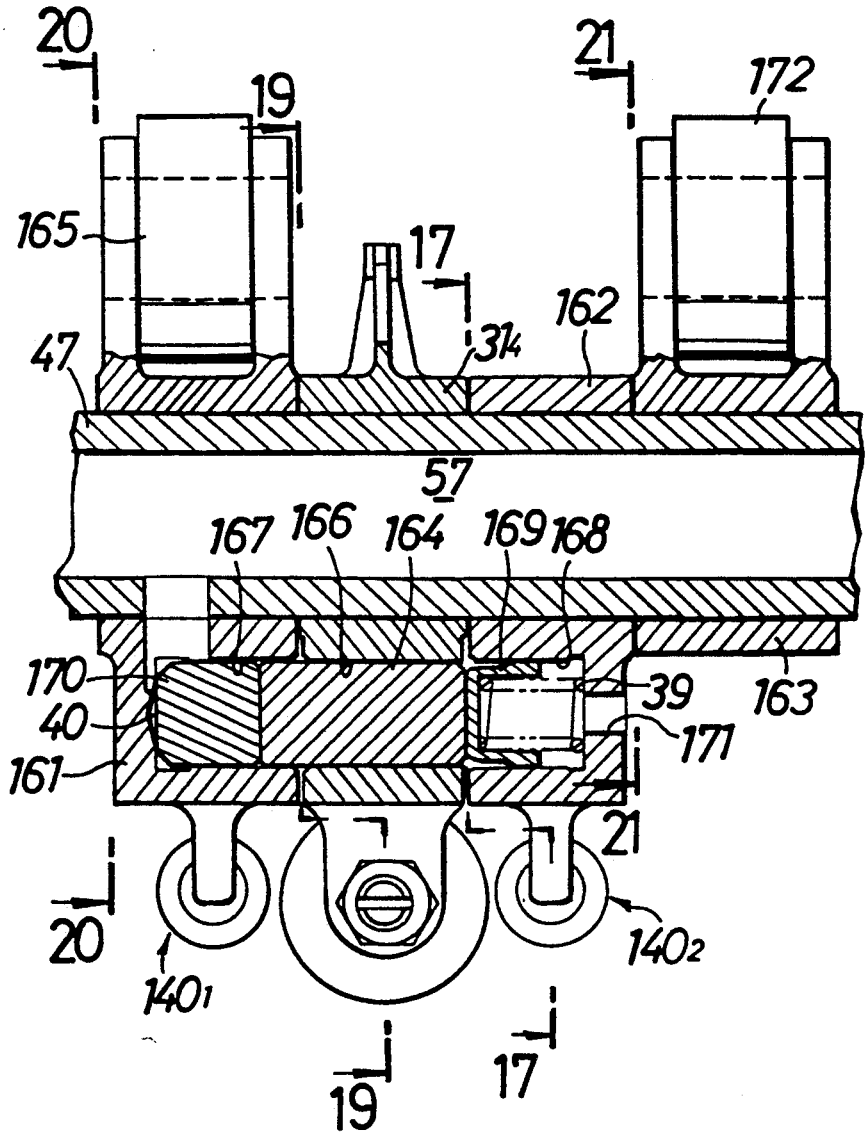
Figure 19:
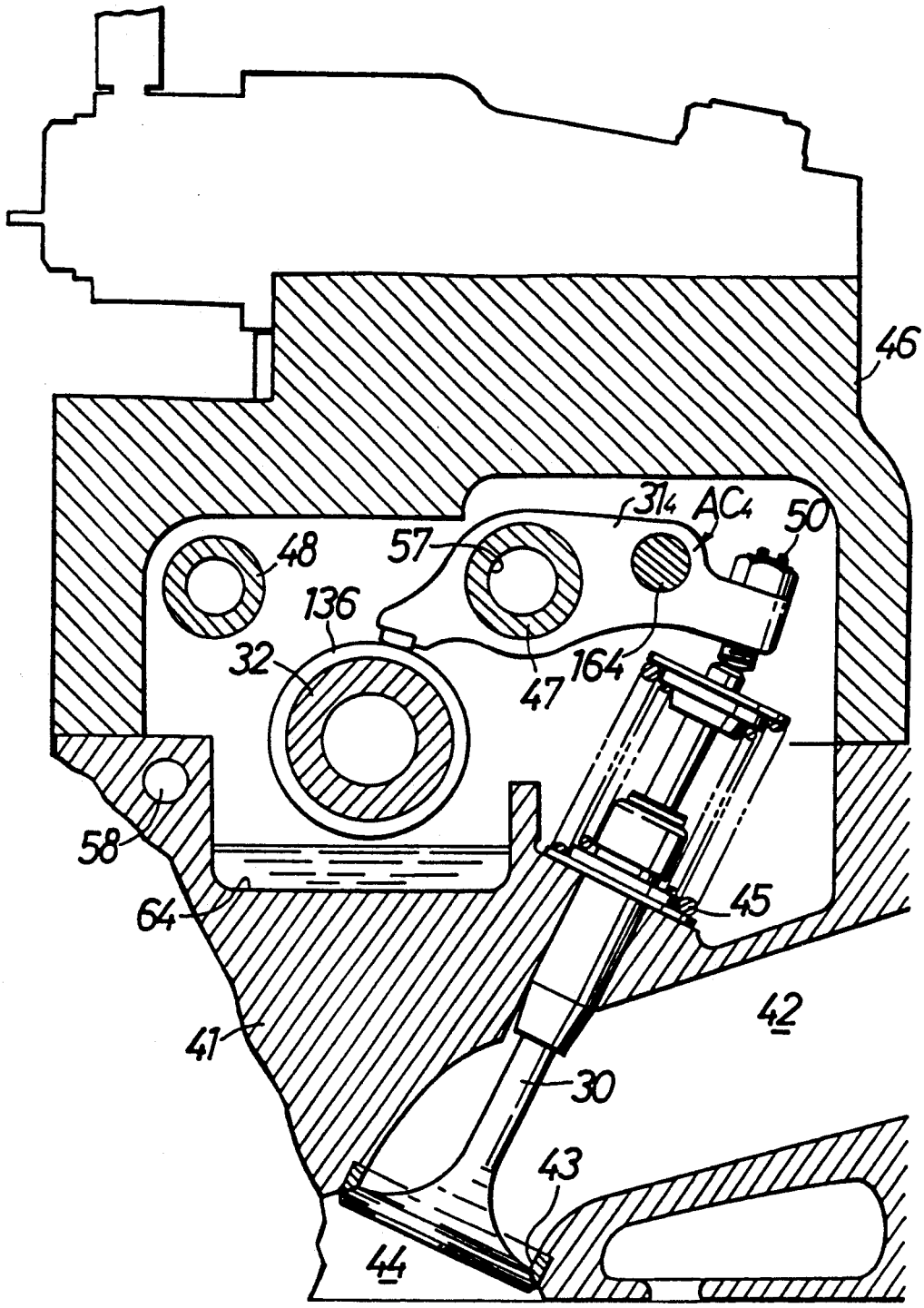

As shown in FIG. 18, the drive rocker arm $31_4$, the first free rocker arm 161 and the second free rocker arm 162 are swingably carried on the intake-side rocker shaft 47, so that the first and second free rocker arms 161 and 162 adjoin opposite sides of the drive rocker arm $31_4$. The plunger rocker arm 163 is swingably carried on the intakeside rocker shaft 47, so that it adjoins the second free rocker arm 162 on the opposite side from the drive rocker arm $31_4$.

Figure 20:
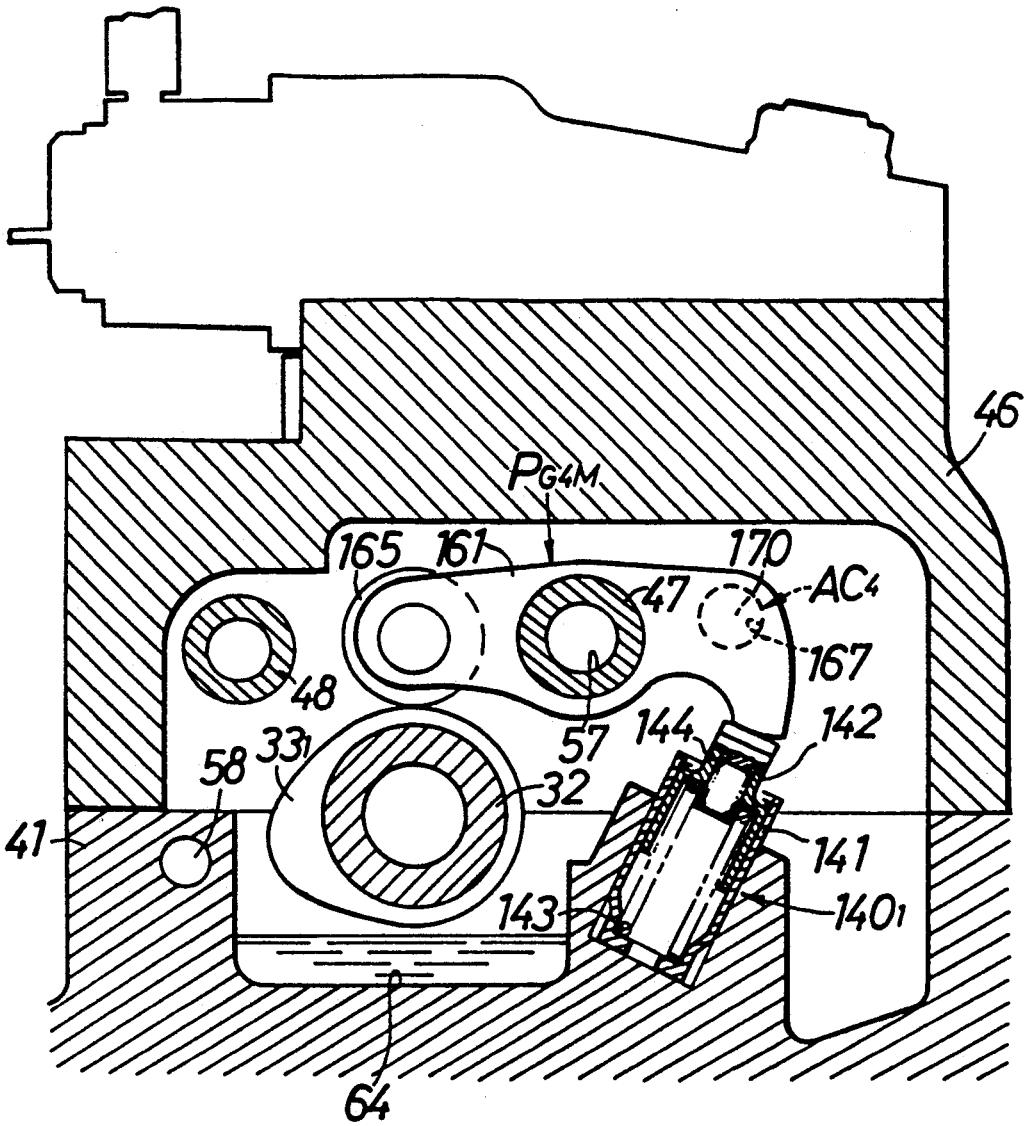
Figure 21:
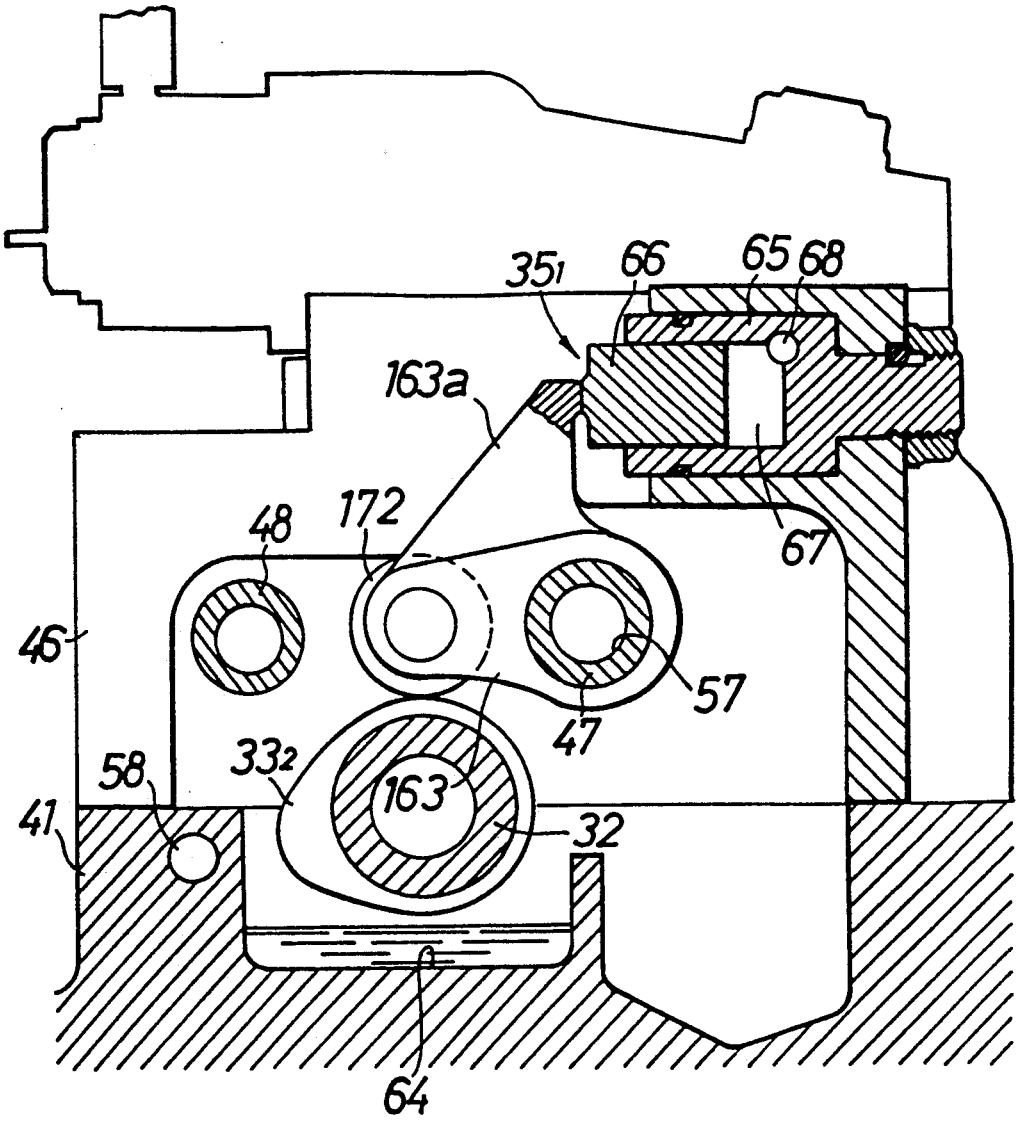

Referring also to FIG. 20, a roller 165 is carried by a pin on the first free rocker arm 161 constituting the mechanical transmission operating-force generating means $P_{G4M}$ to come into rolling contact with the cam $33_1$. A resiliently biasing means $140_1$ is mounted in the cylinder head 41 for exhibiting a resilient force in a direction to bring the roller 165 into rolling contact with the cam $33_1$. Thus, the first free rocker arm 161 is swingably driven with a characteristic corresponding to the shape of the cam $33_1$ by the rotation of the cam shaft 32 corresponding to the revolution of the engine.

The drive rocker arm $31_4$ swingably carried on the intake-side rocker shaft 47 is operatively connected to the intake valve 30 through a tappet screw 50 and is in sliding contact with a circular raised portion 136 provided on the cam shaft 32. A guide hole 166 is provided in the drive rocker arm $31_4$ in parallel to the intakeside rocker shaft 47 and opened to the opposite first and second free rocker arms 161 and 162. A bottomed guide hole 167 corresponding to the guide hole 166 is provided in the first free rocker arm 161 in parallel to the intake-side rocker shaft 47 and opened to the drive rocker arm $31_4$. A bottomed guide hole 168 is provided in the second free rocker arm 162 at a location corresponding to the guide hole 166 and opened to the drive rocker arm $31_4$.

The connecting pin 164 constituting the mechanical transmitting means $T_{M4}$ together with the drive rocker arm $31_4$ and the first free rocker arm 161 is slidably received in the guide hole 166 for movement between a position (shown in FIGS. 16 and 18) in which it rigidly connects the drive rocker arm $31_4$ and the first free rocker arm 161 to each other, but disconnects the drive rocker arm $31_4$ and the second free rocker arm 162 from each other, and a position in which it disconnects the drive rocker arm $31_4$ and the first free rocker arm 161 from each other, but rigidly connects the drive rocker arm $31_4$ and the second free rocker arm 162 to each other.

The selective switchover means $AC_4$ comprises a restraining member 169, a spring 39 and a switchover piston 170. The restraining member 169 is formed into a bottomed cylindrical shape and slidably received in the guide hole 168 to abut against one end of the connecting pin 164. The spring 39 is mounted in a compressed manner between a closed end of the guide hole 168 and the restraining member 169. The switchover piston 170 is slidably received in the guide hole 167 to abut against the other end of the connecting pin 164 and to define a hydraulic pressure chamber 40 between the piston 170 itself and a closed end of the guide hole 167. An opened aperture 171 is provided in the closed end of the guide hole 168. The hydraulic pressure chamber 40 normally communicates with the hydraulic pressure passage 57 in the intake-side rocker shaft 47.

In such selective switchover means $AC_4$, the axial length of each of the connecting pin 164, the restraining member 169 and the switchover piston 170 is set so that the connecting pin 164 is received into both the guide holes 166 and 167 and the abutment surfaces of the connecting pin 164 and the restraining member 169 are located between the opposed surfaces of the drive rocker arm $31_4$ and the second free rocker arm 162 in a condition in which the switchover piston 170 has been moved to the maximum in a direction to reduce the volume of the hydraulic pressure chamber 40, and so that the abutment surfaces of the connecting pin 164 and the switchover piston 170 are located between the opposed surfaces of the drive rocker arm $31_4$ and the first free rocker arm 161 and the connecting pin 164 is received into both the guide holes 166 and 168 in a condition in which the restraining member 169 has been moved to a position to abut against the closed end of the guide hole 168.

The hydraulic pressure generating portion $35_1$ in the hydraulic pressure transmitting means $T_{04}$ is disposed in the support block 46, so that a follower piston 66 comes into sliding contact with an urging portion 163*a* integrally provided on the plunger rocker arm 163. A roller 172 is carried by a pin on the plunger rocker arm 163 to come into rolling contact with the cam $33_2$ provided on the cam shaft 32. Thus, the follower piston 66 is slidably driven by the plunger rocker arm 163 swung in response to the rotation of the cam $33_2$, thereby generating a hydraulic pressure in the hydraulic pressure chamber 67.

The operating-force conversion portion $36_3$ in the hydraulic transmitting means $T_{04}$ comprises a second cylinder 70 fixed in the support block 46, a drive piston 72 slidably received in the second cylinder 70 to define a hydraulic pressure chamber 71 between the piston 72 itself and the second cylinder 70, and a second free rocker arm 162 operatively connected to the drive piston 72. The second free rocker arm 162 is biased in a direction to abut against the drive piston 72 by a resilient biasing means $140_2$ disposed in the cylinder head 41.

The structure with respect to the second cylinder 70 and the drive piston 72 is similar to those in the previously-described embodiments. A hydraulic pressure releasing valve 37, an accumulator 79, a one-way valve 80 and a check valve 81 are disposed as in the first through third embodiments.

The operation of the fourth embodiment will be described below. When the introduction of the working oil having an extremely low temperature or an inappropriate viscosity, or the like, results in an abnormally increased viscosity of the working oil, as well as when it is observed that an abnormal closing of the oil passage 68, 82, 87 or the like in the hydraulic transmitting means $T_{02}$, an abnormality of the pump 60 or the like has been produced, the communication between the pump 60 and the oil passage 57 is cut off by the solenoid switchover control valve 62, thereby reducing the hydraulic pressure in the oil passage 57, and the hydraulic pressure releasing valve 37 is left opened. By doing so, in the selective switchover means $AC_4$, the spring force of the spring 39 is exhibited to cause a position in which the connecting pin 164 extends over both the guide holes 166 and 167, so that the mechanical transmitting means $TM_4$ is brought into a state in which the drive rocker arm $31_4$ and the first free rocker arm 161 are rigidly connected to each other by the connecting pin 164. On the other hand, the selective switchover means $AC_4$ is in a state in which the drive rocker arm $31_4$ and the second free rocker arm 162 are disconnected from each other, and the operating-force conversion portion $36_3$ and the drive rocker arm $31_4$ are disconnected from each other. Therefore, no operating force is transmitted by the hydraulic transmitting means $T_{04}$. As a result, the intake valve 30 is driven to be opened and closed by the mechanical transmission of the operating force from the operating-force generating means $P_{G4M}$ to the drive rocker arm $31_4$ by the mechanical transmitting means $T_{M4}$. In this case, the hydraulic pressure releasing valve 37 in the hydraulic transmitting means $T_{04}$ is in its opened state.

When the temperature of the working oil is increased until the viscosity thereof becomes sufficiently low, or when the working oil having an appropriate viscosity is introduced, as well as when any abnormal closing of the oil passages 68, 82, 87 or the like in the hydraulic transmitting means $T_{01}$ or any abnormality of the pump 60 is not produced, the pump 60 and the oil passage 57 are put into communication with each other by the solenoid switchover control valve 62, thereby increasing the hydraulic pressure in the oil passage 57. By doing so, in the selective switchover means $AC_4$, the connecting pin 164 is caused to be moved, until it is received into the guide hole 168 with its abutment surface against the switchover piston 170 being located between the opposed surfaces of the drive rocker arm $31_4$ and the first free rocker arm 161, so that the mechanical transmitting means $T_{M4}$ is brought into a state in which the connection through the connecting pin 153 is released. On the other hand, in the hydraulic transmitting means $T_{04}$, the second free rocker arm 161 is connected to the drive rocker arm $31_4$, thereby causing the hydraulic pressure generated in the hydraulic pressure generating portion $35_1$ to be converted into an operating force in the operating-force conversion portion $36_3$, which is then applied to the drive rocker arm $31_4$. Therefore, no operating force is transmitted by the mechanical transmitting means $T_{M4}$, and the intake valve 30 is driven to be opened and closed by the transmission of the operating force by the hydraulic transmitting means $T_{04}$. In this case, the lift amount of and the closing timing for the intake valve 30 can be controlled by controlling the timing of release of the hydraulic pressure by the hydraulic pressure releasing valve 37 in the hydraulic transmitting means $T_{04}$.

Moreover, different shapes of the cams $33_1$ and $33_2$ make it possible to provide different operational characteristics of the intake valve 30 when the intake valve 30 is mechanically driven by the mechanical transmitting means $T_{M4}$ and when the intake valve 30 is hydraulically driven by the hydraulic transmitting means $T_{O4}$. A fifth embodiment of the present invention will be described in connection with FIGS. 22 to 27.

Figure 22:
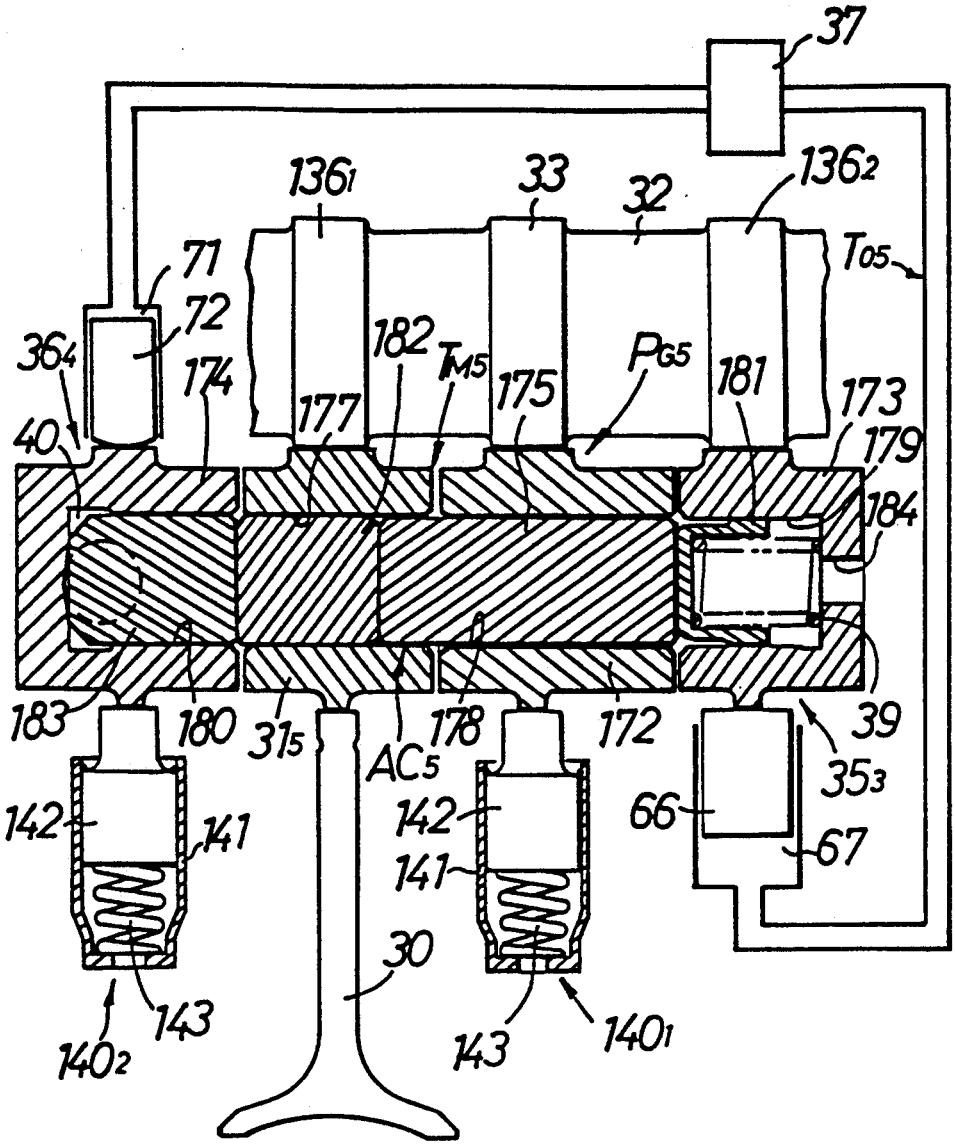

Referring to FIG. 22, a valve operating system of this embodiment comprises an operating-force generating means $P_{G5}$ for generating an operating force corresponding to the revolution of the engine, a drive rocker arm $31_5$ as an operating-force applying means for operating the intake valve 30, a hydraulic transmitting means $T_{O5}$ capable of hydraulically transmitting the operating force from the operating-force generating means $P_{G5}$ to the drive rocker arm $31_5$, a mechanical transmitting means $T_{M5}$ capable of mechanically transmitting the operating force from the operating-force generating means $P_{G5}$ to the drive rocker arm $31_5$, and a selective switchover means $AC_5$ capable of simultaneously switching-over inputs into the hydraulic and mechanical transmitting means $T_{O5}$ and $T_{M5}$ from the operating-force generating means $P_{G5}$ as well as outputs from the hydraulic and mechanical transmitting means $T_{O5}$ and $T_{M5}$ to the drive rocker arm $31_5$.

The operating-force generating means $P_{G5}$ is comprised of a cam 33 provided on a cam shaft 32, and a first free rocker arm 172 swingably driven by the cam 33. The hydraulic transmitting means $T_{O5}$ comprises a hydraulic pressure generating portion $35_3$ for generating a hydraulic pressure corresponding to the operation of a second free rocker arm 173 which is swung when being connected to the first free rocker arm 172, an operating-force conversion portion $36_4$ constructed with a third free rocker arm 174 as a component disposed adjacent a drive rocker arm $31_5$ for converting the hydraulic pressure from the hydraulic pressure generating portion $35_3$ into an operating force to transmit it to the drive rocker arm $31_5$, and a hydraulic pressure releasing valve 37 capable of releasing the hydraulic pressure in the operating-force conversion portion $36_4$. The mechanical transmitting means $T_{M5}$ comprises the drive rocker arm $31_5$ and the first free rocker arm 172 which are disposed adjacent each other, and a connecting pin 175 which is movable between a position in which it connects the drive rocker arm $31_5$ and the first free rocker arm 172 to each other and a position in which such connection is released. The selective switchover means $AC_5$ is constructed for switchover of a state in which the drive rocker arm $31_5$ and the first free rocker arm 172 are connected to each other, while the connection between the drive rocker arm $31_5$ and the third free rocker arm 174 and the connection between the first and second free rocker arms 172 and 173 are released, and a state in which the connection between the drive rocker $31_5$ and the first free rocker arm 172 is released, while the drive rocker arm $31_5$ and the third free rocker arm 174 are connected to each other and the first and second free rocker arms 172 and 173 are connected to each other.

Figure 24:
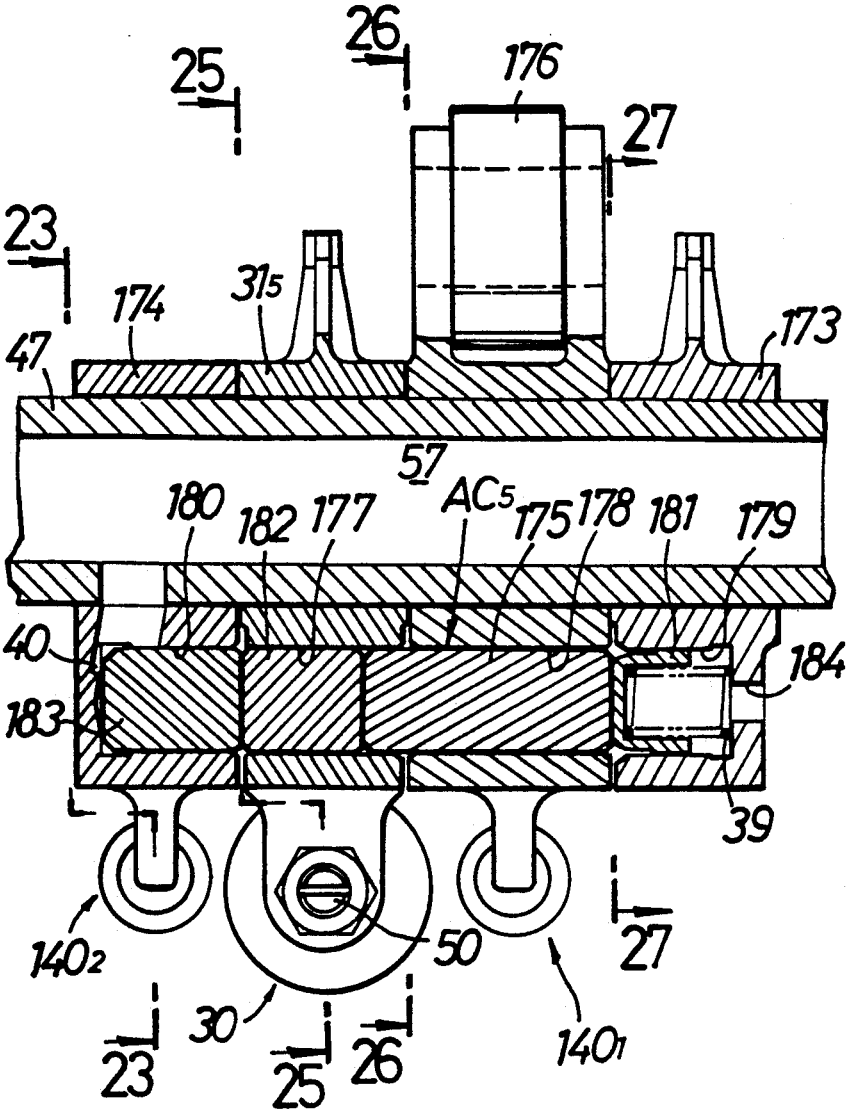
Figure 25:
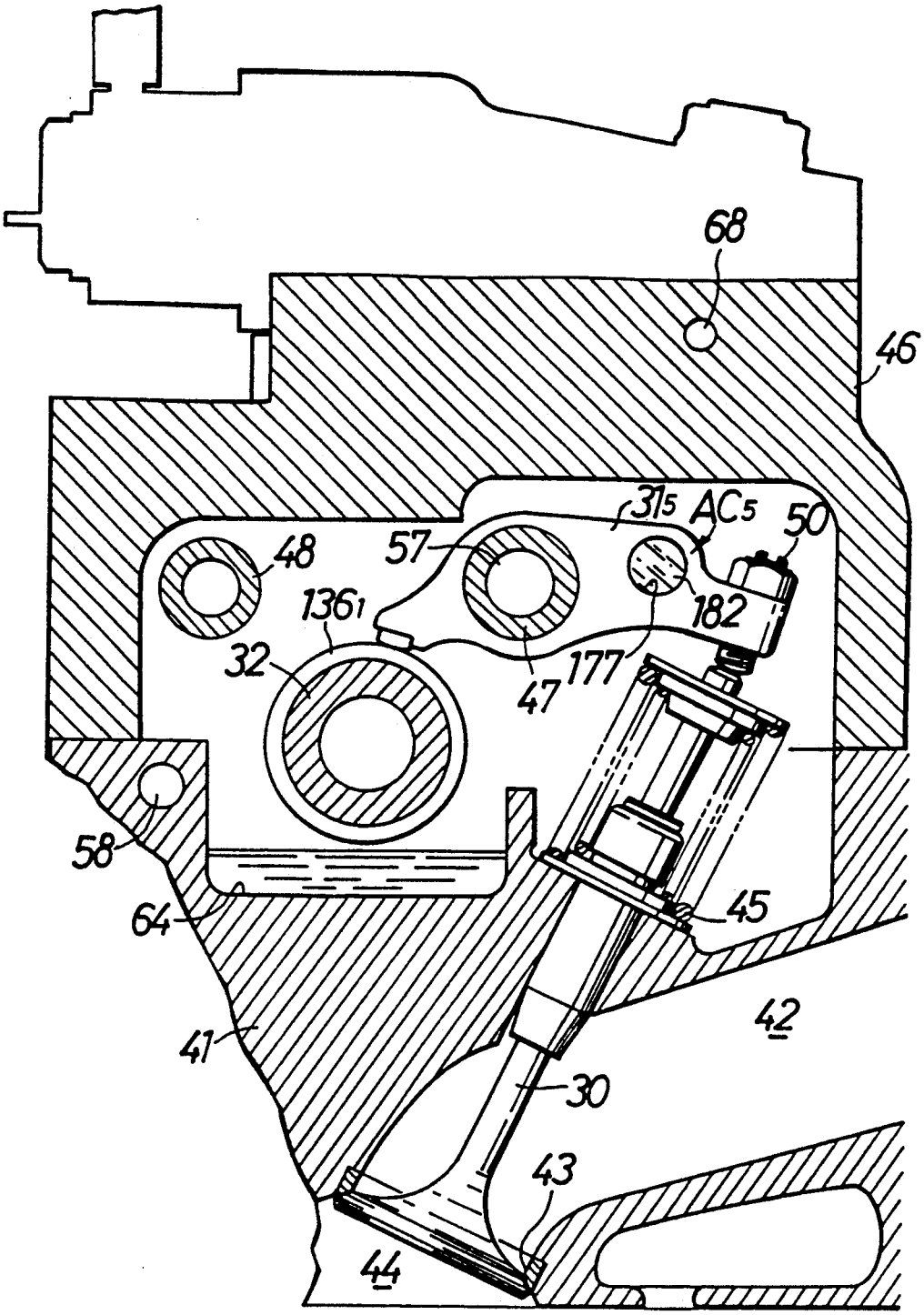

As best shown in FIG. 24, the drive rocker arm $31_5$ and the first, second and third free rocker arms 172, 173 and 174 are swingably carried on the intake-side rocker shaft 47, so that the first and third free rocker arms 172 and 174 opposite sides of the drive rocker arm $31_5$ and so that the second free rocker arm 173 adjoins the first free rocker arm 172 on the opposite side from the drive rocker arm $31_5$.

Figure 26:
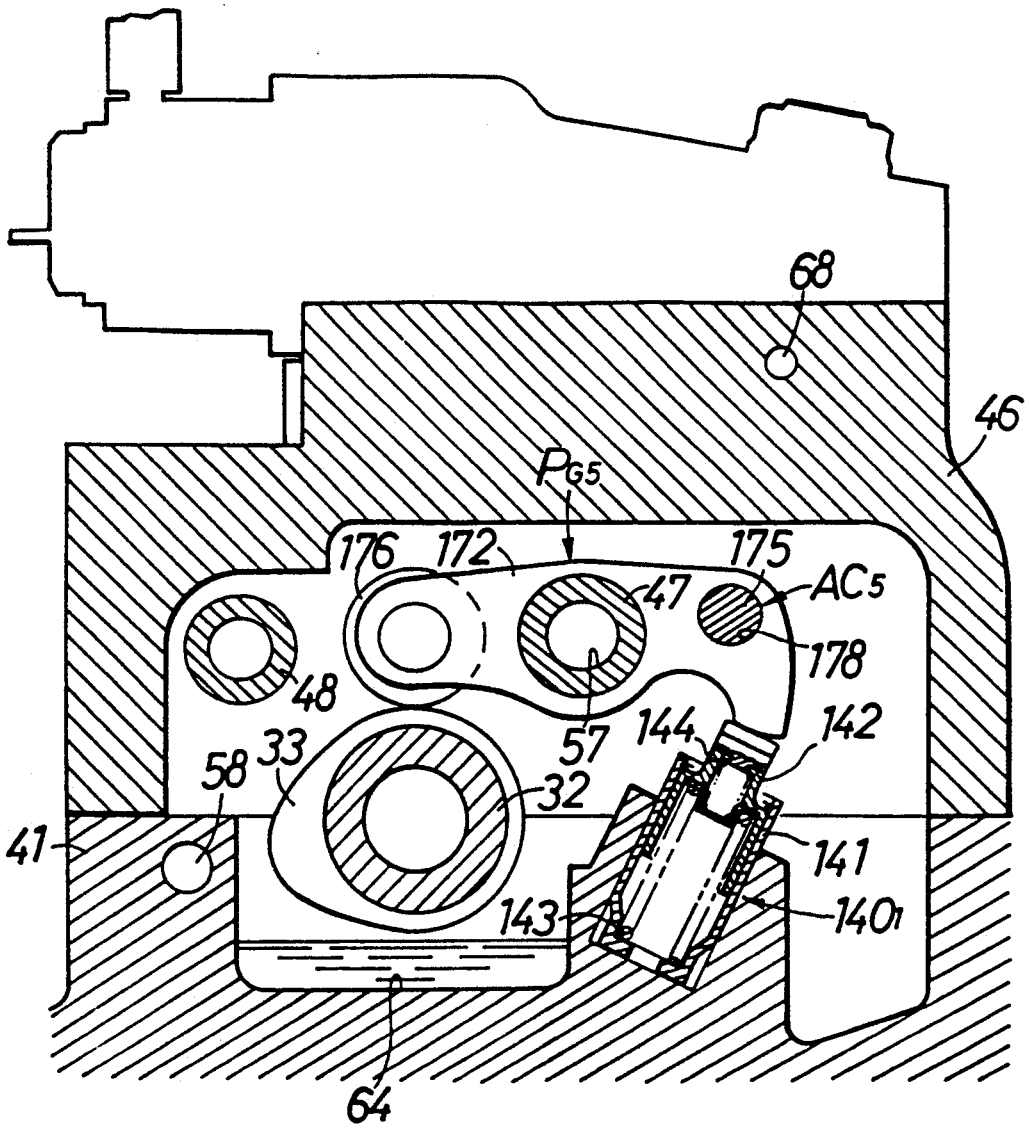

Referring also to FIG. 26, a roller 176 is carried by a pin on the first free rocker arm 172 constituting the operating-force generating means $P_{G5}$ to come into rolling contact with the cam 33. A resilient biasing means $140_1$ is provided in the cylinder head 41 for exhibiting a resilient force in a direction to bring the roller 176 into rolling contact with the cam 33. Thus, the first free rocker arm 172 is swung with a characteristic corresponding to the shape of the cam 33 by the rotation of the cam shaft 32 corresponding to the revolution of the engine.

The drive rocker arm $31_5$ swingably carried on the intake-side rocker shaft 47 is operatively connected to the intake valve 30 through a tappet screw 50 and is in sliding contact with a circular raised portion $136_1$ provided on the cam shaft 32. A guide hole 177 is provided in the drive rocker arm $31_5$ in parallel to the intake-side rocker shaft 47 and opened to the opposite first and third rocker arms 172 and 174. A guide hole 178 is provided in the first free rocker arm 172 in correspondence to the guide hole 177 and in parallel to the rocker shaft 47 and opened to the drive rocker arm $31_5$ and second free rocker arm 173. A bottomed guide hole 179 is provided in the second free rocker arm 173 at a location corresponding to the guide hole 178 and in parallel to the rocker shaft 47 and opened to the first free rocker arm 172. A bottomed guide hole 180 is provided in the third free rocker arm 174 at a location corresponding to the guide hole 177 and in parallel to the rocker shaft 47 and opened to the drive rocker arm $31_5$.

The connecting pin 175 constituting the mechanical transmitting means $T_{M5}$ together with the drive rocker arm $31_5$ and the first free rocker arm 172 is slidably received in the guide hole 178 for movement between a position (shown in FIGS. 22 and 24) in which it is fitted into both the guide holes 177 and 178 to rigidly connect the drive rocker arm $31_5$ and the first free rocker arm 172 to each other, and a position in which it releases such connection.

The selective switchover means $AC_5$ comprises a restraining member 181, a spring 39, a pin 182 and a switchover piston 183. The restraining member 181 is formed into a bottomed cylindrical shape and slidably received in the guide hole 179 to abut against one end of the connecting pin 175. The pin 182 is slidably received in the guide hole 177 with one end abutting against the other end of the connecting pin 175. The switchover piston 183 is slidably received in the guide hole 180 to abut against the other end of the pin 182 and define a hydraulic pressure chamber 40 between the piston 183 itself and a closed end of the guide hole 180. An opened aperture 184 is provided in a closed end of the guide hole 179. The hydraulic pressure chamber 40 normally communicates with the hydraulic pressure passage 57 in the intake-side rocker shaft 47.

In such selective switchover means $AC_5$, the axial length of each of the connecting pin 175, the restraining member 181, the pin 182 and the switchover piston 183 is set so that when the connecting pin 175 is fitted into both the guide holes 177 and 178, abutment surfaces of the connecting pin 175 and the restraining member 181 are located between opposed surfaces of the first and second free rocker arms 172 and 173, and abutment surfaces of the pin 182 and the switchover piston 183 are located between opposed surfaces of the drive rocker arm $31_5$ and the third free rocker arm 174, in a condition in which the switchover piston 182 has been moved to the maximum in a direction to reduce the volume of the hydraulic pressure chamber 40, and so that when the abutment surfaces of the connecting pin 175 and pin 182 are located between opposed surfaces of the drive rocker arm $31_5$ and the first free rocker arm 172, the connecting pin 175 is fitted into both the guide holes 178 and 179 and the switchover piston 183 is received into both the guide holes 180 and 177, in a condition in which the restraining member 181 has been moved until it has abutted against the closed end of the guide hole 179.

Figure 27:
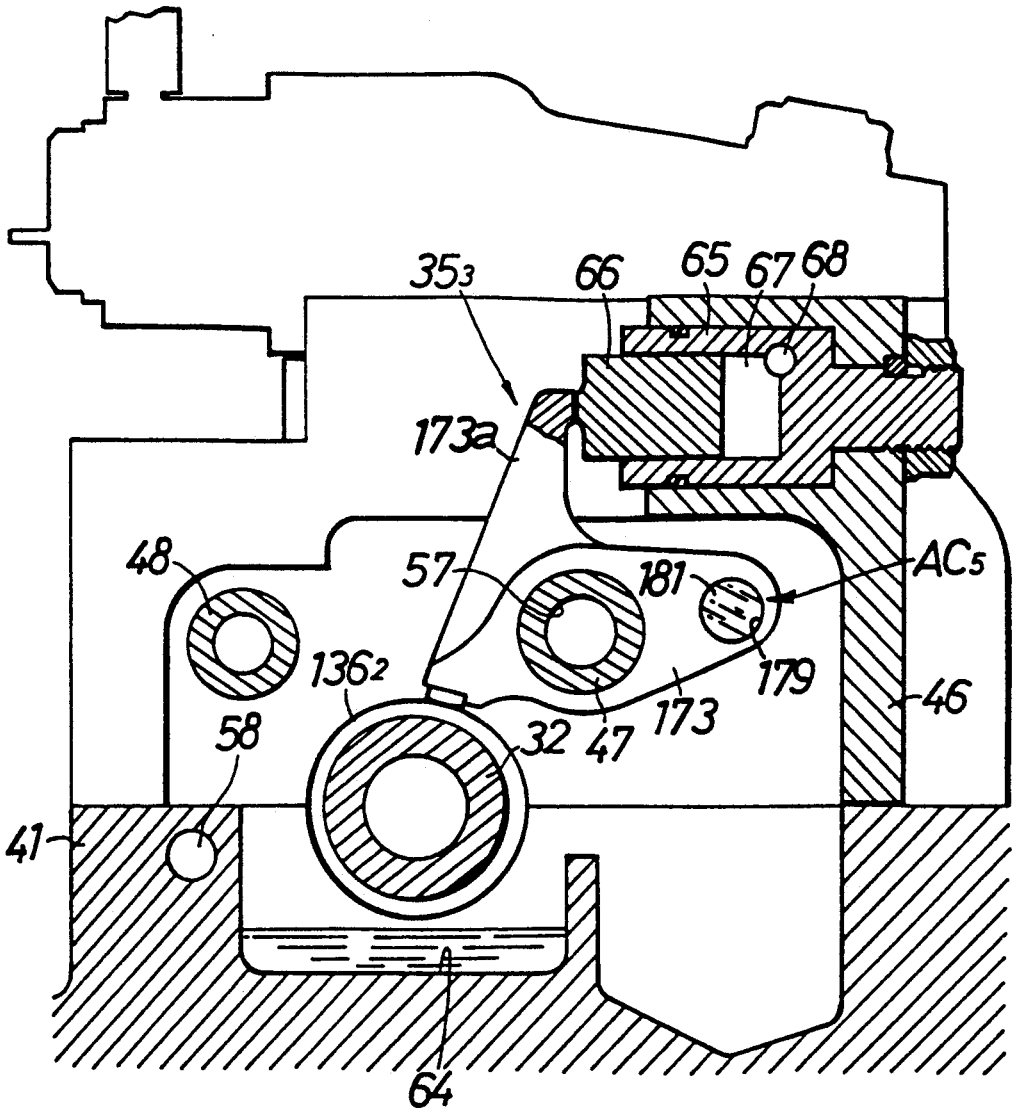

Referring to FIG. 27, the hydraulic pressure generating portion $35_3$ in the hydraulic transmitting means $T_{O5}$ is disposed so that a follower piston 66 comes in sliding contact with an urging portion 173*a* integrally provided on the second free rocker arm 173. The second free rocker arm 173 is in sliding contact with a raised portion $163_2$ provided on the cam shaft 32. Thus, the follower piston 66 is slidably driven by the second free rocker arm 173 swung in response to the rotation of the cam 33 in a condition in which the second free rocker arm 173 has been connected to the first free rocker arm 172, thereby generating a hydraulic pressure in the hydraulic pressure generating chamber 67.

Figure 23:
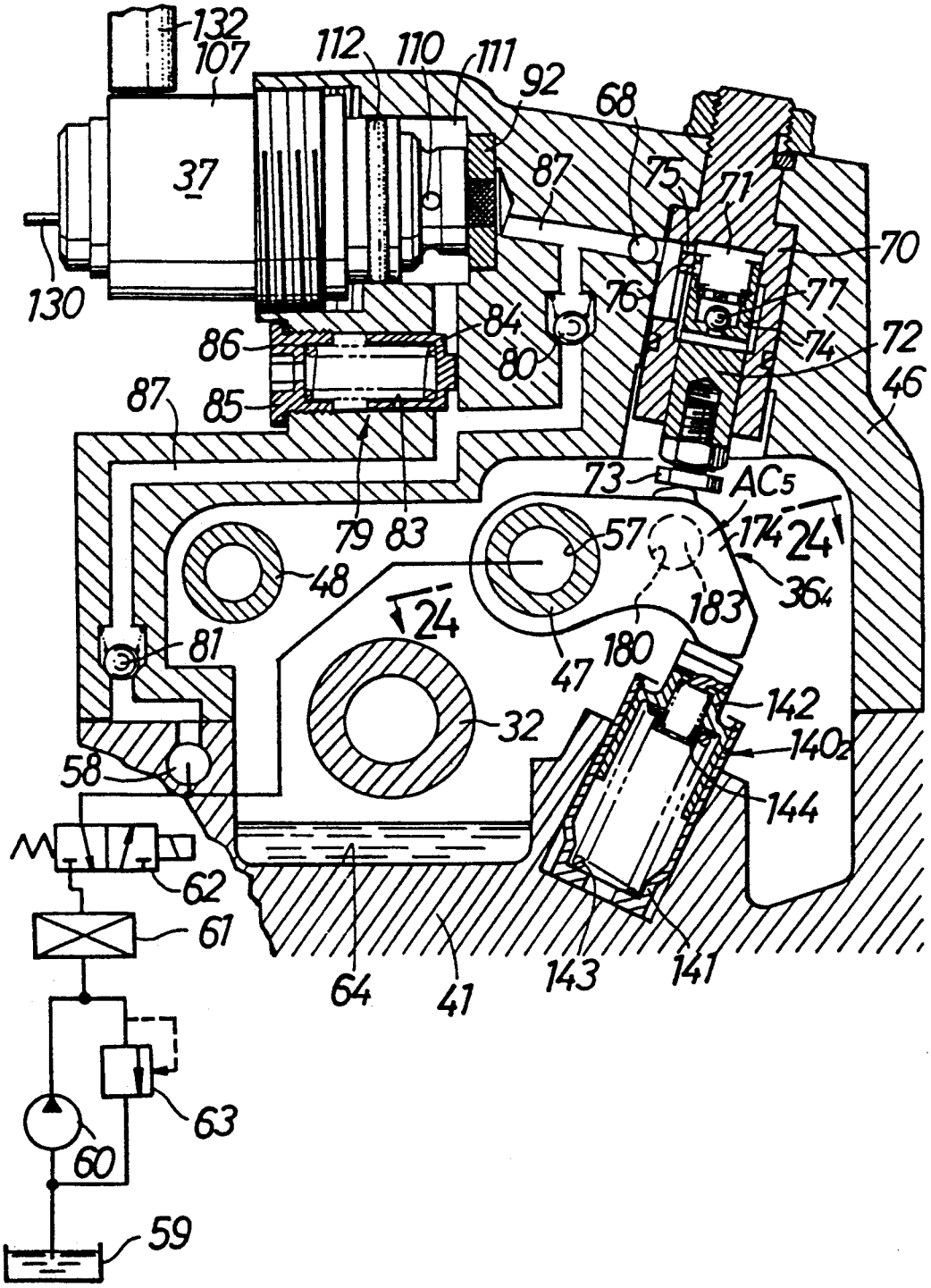

Referring to FIG. 23, the operating-force conversion portion $36_4$ in the hydraulic transmitting means $T_{O5}$ comprises a second cylinder 70 fixed in the support block 46, a drive piston 72 slidably received in the second cylinder 70 to define a hydraulic pressure chamber 71 between the piston 72 itself and the second cylinder 70, and the third free rocker arm 174 operatively connected to the drive piston 72. The third free rocker arm 174 is biased in a direction to abut against the drive piston 72 by a resilient biasing means $140_2$ disposed in the cylinder head 41.

The structure with respect to the second cylinder 70 and the drive piston 72 is similar to those in the previously described embodiments. A hydraulic pressure releasing valve 37, an accumulator 79, a one-way valve 80 and a check valve 81 are disposed in the support block 46, as in the first through fourth embodiments.

The operation of the fifth embodiment will be described. When the introduction of the working oil having an extremely low temperature or an inappropriate viscosity, or the like, results in an abnormally increased viscosity of the working oil, as well as when it is observed that an abnormal closing of the oil passage 68, 82, 87 or the like in the hydraulic transmitting means $T_{02}$, an abnormality of the pump 60 or the like has been produced, the communication between the pump 60 and the oil passage 58 is cut off by the solenoid switchover control valve 62, thereby reducing the hydraulic pressure in the oil passage 57. By doing so, in the selective switchover means $AC_5$, the spring force of the spring 39 is exhibited to cause a position in which the connecting pin 175 extends over both the guide holes 177 and 178, so that the mechanical transmitting means $T_{M5}$ is brought into a state in which the drive rocker arm $31_3$ and the first free rocker arm 172 are rigidly connected to each other by the connecting pin 175. On the other hand, the selective switchover means $AC_5$ is in a state in which the drive rocker arm $31_5$ and the third free rocker arm 174 are disconnected from each other, and the first and second free rocker arms 172 and 173 are disconnected from each other, so that the operating-force generating means $P_{G5}$ and the hydraulic pressure generating portion $35_3$ are disconnected from each other, and the operating-force conversion portion $36_3$ and the drive rocker arm $31_5$ are disconnected from each other. Therefore, no operating force is transmitted by the hydraulic transmitting means $T_{O5}$. As a result, the intake valve 30 is driven to be opened and closed by the mechanical transmission of the operating force from the operating-force generating means $P_{G5}$ to the drive rocker arm $31_5$ by the mechanical transmitting means $T_{M5}$. In this case, the hydraulic pressure releasing valve 37 in the hydraulic transmitting means $T_{O5}$ is in its opened state by deenergisation thereof for saving the electric power.

When the temperature of the working oil is increased until the viscosity thereof becomes sufficiently low, or when the working oil having an appropriate viscosity is introduced, as well as when any abnormal closing of the oil passages 68, 82, 87 or the like in the hydraulic transmitting means $T_{O5}$ or any abnormality of the pump 60 is not produced, the pump 60 and the oil passage 57 are put into communication with each other by the solenoid switchover control valve 62, thereby increasing the hydraulic pressure in the oil passage 57. By doing so, in the selective switchover means $AC_5$. the connecting pin 175 is caused to be moved by an increased hydraulic pressure in the hydraulic pressure chamber 40, until it is received into the guide hole 179 with its abutment surface against the pin 182 being located between the opposed surfaces of the drive rocker arm $31_5$ and the first free rocker arm 172, and further, the switchover piston 183 is received into the guide hole 177. Therefore, in the mechanical transmitting means $T_{M5}$, the connection through connecting pin 175 is released. On the other hand, in the hydraulic transmitting means $T_{O5}$, the second free rocker arm 173 is connected to the first free rocker arm 172, thereby generating a hydraulic pressure in the hydraulic pressure generating portion $35_3$, and the third free rocker arm 174 is connected to the drive rocker arm $31_5$, so that such hydraulic pressure is converted into an operating force in the operating-force conversion portion $36_4$ and applied in the form of the operating force to the drive rocker arm $31_5$. Therefore, no operating force is transmitted by the mechanical transmitting means $T_{M5}$, and the intake valve 30 is driven to be opened and closed by the transmission of the operating force by the hydraulic transmitting means $T_{O5}$. In this case, the lift amount of and the closing timing for the intake valve 30 can be controlled by controlling the timing of release of the hydraulic pressure by the hydraulic pressure releasing valve 37 in the hydraulic transmitting means $T_{O5}$.

What is claimed is:

1. A valve operating system in an internal combustion engine, comprising an operating-force generating means for generating an operating force corresponding to the revolution of the engine, an operating-force applying means for operating an engine valve, a hydraulic transmitting means capable of hydraulically transmitting the operating force between the operating-force generating means and the operating-force applying means, a mechanical transmitting means capable of rigidly transmitting the operating force between the operating-force generating means and the operating-force applying means, and a selective switchover means capable of alternatively switching-over between the transmission of the operating force from the operating-force generating means to the operating-force applying means by the hydraulic transmitting means and the transmission of the operating force from the operating-force generating means to the operating-force applying means by the mechanical transmitting means, said selective switchover means serving to discontinue said operating-force transmission by the mechanical transmitting means during said operating-force transmission by the hydraulic transmitting means by disconnecting said mechanical transmitting means from said operating-force applying means.

2. A valve operating system in an internal combustion engine according to claim 1, wherein said selective switchover means is arranged for alternative switchover between an input from the operating-force generating means into the hydraulic transmitting means and an input from the operating-force generating means into the mechanical transmitting means.

3. A valve operating system in an internal combustion engine according to claim 1, wherein said selective switchover means is arranged for alternative switchover between an output from the hydraulic transmitting means to the operating-force applying means and an output from the mechanical transmitting means to the operating-force applying means.

4. A valve operating system in an internal combustion engine according to claim 1, wherein said selective switchover means is arranged for simultaneous switchover between an input from the operating-force generating means into the hydraulic transmitting means and an input from the operating-force generating means into the mechanical transmitting means, and between an output from the hydraulic transmitting means to the operating-force applying means and an output from the mechanical transmitting means to the operating-force applying means.

5. A valve operating system in an internal combustion engine according to any of claims 1 to 4, wherein said mechanical transmitting means comprises a plurality of rocker arms including a rocker arm as a component for said operating-force generating means and a rocker arm as a component for said operating-force applying means, and a connecting pin movable between a position in which it connects the rocker arms and a position in which it releases such connection, and said selective switchover means comprises a spring for applying a spring force to one end of said connecting pin for biasing said connecting pin toward the connecting position, and a hydraulic pressure chamber adapted to apply to the other end of the connecting pin a hydraulic pressure force provided by a hydraulic pressure capable of being controlled in switchover of one of high and low levels to the other.

6. A valve operating system in an internal combustion engine according to any of claims 1 to 4, wherein said hydraulic transmitting means comprises a hydraulic pressure generating portion for generating a hydraulic pressure by an input from the operating-force generating means, an operating-force conversion portion capable of converting the hydraulic pressure in a hydraulic pressure chamber leading to said hydraulic pressure generating portion into an operating force supplied to the operating-force applying means, and a hydraulic pressure releasing valve capable of releasing the hydraulic pressure in said hydraulic pressure chamber.

7. A valve operating system in an internal combustion engine, comprising first means for generating a valve operating force, second means for operating an engine valve, third means for hydraulically transmitting said operating force between said first and second means, fourth means for mechanically transmitting said operating force between said first and second means, and means for selectively causing operation of one of said third and fourth means for hydraulically and mechanically, respectively, transmitting said operating force from said first means to said second means, said means for selectively causing operating serving to discontinue said transmitting of said operating force by said fourth means during said transmitting of said operating force by said third means by disconnecting said fourth means from said second means.

8. A valve operating system in an internal combustion engine according to claim 7, wherein said first means include a cam on a rotatable camshaft and a movably supported rocker arm for engaging said cam.

9. A valve operating system in an internal combustion engine according to claim 7, wherein said second means includes a movably supported rocker arm for engaging the valve.

10. A valve operating system in an internal combustion engine according to claim 8, wherein said second means includes a second movably supported rocker arm for engaging the valve, and said fourth means includes means for selectively coupling the first said rocker arm and said second rocker arm for mechanical transmitting the operating force.

11. A valve operating system in an internal combustion engine according to claim 10, wherein said fourth means includes a hole in each said rocker arm and a pin slidably mounted in one of said holes, said pin being selectively movable into the hole in the other of said rocker arms for causing said coupling.

12. A valve operating system according to claim 7, wherein said third means includes a pair of movably supported rocker arms and a piston in a cylinder engaging each said rocker arm with said cylinders being hydraulically connected, and wherein movement of one piston by a rocker arm causes movement of the other piston to cause movement of the other rocker arm.

13. A valve operating system in an internal combustion engine according to claim 7, wherein said fourth means comprises a plurality of pivotally mounted rocker arms including a rocker arm as a component of said first means and a rocker arm as a component of said second means, and a connecting pin movable between a position in which it connects the rocker arms and a position in which it releases such connection, and said means for selectively causing operation comprises a spring for applying a spring force to one end of said connecting pin for biasing said connecting pin toward the connecting position, and a hydraulic pressure chamber for applying to the other end of the connecting pin a hydraulic pressure force provided by a hydraulic pressure source capable of being selectively controlled.

14. A valve operating system in an internal combustion engine according to any of claims 7 to 11, wherein said third means comprises a hydraulic pressure generating portion for generating a hydraulic pressure by an input from the first means, an operating-force conversion portion capable of converting the hydraulic pressure in a hydraulic pressure chamber leading to said hydraulic pressure generating portion into an operating force supplied to the second means, and a hydraulic pressure releasing valve capable of releasing the hydraulic pressure in said hydraulic pressure chamber.

15. A valve operating system in an internal combustion engine, comprising a rotatable camshaft having a cam for generating an operating force, a plurality of rocker arms pivotally mounted on a rocker shaft, a first rocker arm having means engaging said cam for causing pivoting, a second rocker arm having means for engaging and operating an engine valve upon pivoting, hydraulic means for hydraulically transmitting the pivoting movement of said first rocker arm to said second rocker arm, mechanical means for rigidly connecting said first and second rocker arms for movement in unison, and means for selectively switching between the transmission of the pivoting movement of said first rocker arm to said second rocker arm by the hydraulic means and the transmission of said pivoting movement by the mechanical means, said means for selectively switching serving to discontinue said transmission of said pivoting movement by said mechanical means during said transmission of pivoting movement by said hydraulic means by disconnecting said mechanical means from said second rocker arm.

16. A valve operating system according to claim 15, wherein said hydraulic means includes a third rocker arm.

17. A valve operating system according to claim 16, wherein said hydraulic means includes a fourth rocker arm.

18. A valve operating system according to claim 15, 16 or 17, wherein each said rocker arm has a hole therein parallel to the rocker shaft, and plural pin means are slidably mounted in said rocker arm holes, said pin means being selectively movable for selective connecting and disconnecting selected rocker arms.

* * * * *

UNITED STATES PATENT AND TRADEMARK OFFICE

CERTIFICATE OF CORRECTION

PATENT NO. : 5,282,443

DATED : February 1, 1994

INVENTOR(S) : Fujiyoshi et al.

It is certified that error appears in the above-indentified patent and that said Letters Patent is hereby corrected as shown below:

Column 27, claim 7, line 51, delete "operating" and insert -- operation --.

Signed and Sealed this

Eleventh Day of October, 1994

*Attest:*

*Attesting Officer*

BRUCE LEHMAN

*Commissioner of Patents and Trademarks*